US010168047B2

(12) United States Patent
Satoh et al.

(10) Patent No.: US 10,168,047 B2
(45) Date of Patent: Jan. 1, 2019

(54) WATER HEATING APPARATUS AND SYSTEM HAVING A SCALE DETECTING FUNCTION

(71) Applicant: NORITZ CORPORATION, Hyogo (JP)

(72) Inventors: Isao Satoh, Kakogawa (JP); Takao Muko, Kobe (JP); Yuiko Yano, Akashi (JP); Yuki Maeshima, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 246 days.

(21) Appl. No.: 15/136,349

(22) Filed: Apr. 22, 2016

(65) Prior Publication Data

US 2017/0108211 A1 Apr. 20, 2017

(30) Foreign Application Priority Data

Oct. 20, 2015 (JP) ..... 2015-206338

(51) Int. Cl.

| | |
|---|---|
| ***F22B 37/38*** | (2006.01) |
| ***F24H 9/00*** | (2006.01) |
| ***F24H 9/20*** | (2006.01) |
| ***F24H 1/14*** | (2006.01) |

(52) U.S. Cl.

CPC ..... *F22B 37/38* (2013.01); *F24H 1/145* (2013.01); *F24H 9/0042* (2013.01); *F24H 9/2035* (2013.01)

(58) Field of Classification Search

CPC ..... F22B 37/38; F24H 1/145; F24H 9/2035; F24H 9/0042

See application file for complete search history.

(56) References Cited

U.S. PATENT DOCUMENTS

| | | | | |
|---|---|---|---|---|
| 6,578,557 B1 * | 6/2003 | Messick | F02D 41/061 | 123/491 |
| 2004/0176858 A1 * | 9/2004 | Kuwahara | G05B 15/02 | 700/9 |
| 2007/0099136 A1 * | 5/2007 | Cook | F24H 9/2035 | 431/77 |

(Continued)

FOREIGN PATENT DOCUMENTS

| | | |
|---|---|---|
| JP | 2008-138952 A | 6/2008 |
| JP | 2014-047980 A | 3/2014 |

*Primary Examiner* — Steven B McAllister
*Assistant Examiner* — Steven Anderson, II
(74) *Attorney, Agent, or Firm* — Studebaker & Brackett PC

(57) ABSTRACT

A control unit includes a scale detection unit for detecting, while the a burner provides combustion, occurrence of clogging with scale in a tube of a heat exchanger, and an output unit for outputting a result of a detection by the scale detection unit, a storage stores information including a numerical value representing how many times a surface temperature of the heat exchanger measured by a temperature measuring unit exceeds at least one of a plurality of threshold values. While the burner provides combustion when the surface temperature measured by the temperature measuring unit exceeds at least one of the plurality of threshold values the scale detection unit adds a predetermined value to the numerical value in the storage and when the numerical value attains a defined value or more the scale detection unit detects occurrence of clogging with scale.

12 Claims, 25 Drawing Sheets

(56) References Cited

U.S. PATENT DOCUMENTS

2013/0312671 A1* 11/2013 Deivasigamani ..... G06F 17/30902 122/1 C
2014/0060458 A1 3/2014 Fujimoto
2014/0369672 A1* 12/2014 Hussain ..... F24H 9/2028 392/480

* cited by examiner

| DISPLAY DATA |
| --- |
| [C1*] |
| [C2*] |
| [C3*] |
| [C4*] |
| [CF*] |

10G

| VALUE OF LOWEST DIGIT | CUMULATIVE COMBUSTION TIME |
| --- | --- |
| 0 | 0～199 |
| 1 | 200～399 |
| 2 | 400～599 |
| 3 | 600～999 |
| 4 | 1000～1399 |
| 5 | 1400～1799 |
| 6 | 1800～2199 |
| 7 | 2200～2599 |
| 8 | 2600～2999 |
| 9 | 3000～ |

FIG.16

10J

| ID | CODE | AT : CUMULATIVE TIME |
|---|---|---|
| X1 | C1 | 610 |
| X2 | C4 | 1810 |
| ⋮ | ⋮ | ⋮ |

FIG.20

10K

| MASTER/SLAVE | CODE | AT : CUMULATIVE TIME | A1 |
|---|---|---|---|
| MASTER | C2 | 810 | 3 |
| SLAVE | C2 | 900 | 3 |

WATER HEATING APPARATUS AND SYSTEM HAVING A SCALE DETECTING FUNCTION

BACKGROUND OF THE INVENTION

Field of the Invention

The present invention relates to a water heating apparatus and system, and more particularly to a water heating apparatus and system having a scale detecting function.

Description of the Background Art

Use of a water heating apparatus for a long time causes a scale to adhere in a pipe of a heat exchanger. In particular, in the case where so-called hard water containing a large quantity of calcium ion and magnesium ion is used, the amount of adhesion of the scale becomes greater. When use of the water heating apparatus with adhesion of the scale continues, normal heat transmission of the heat exchanger may be impaired by the scale, thus damage such as cracks in the heat exchanger may occur due to generation of thermal stress caused by the scale. Accordingly, it is necessary to detect adhesion of the scale appropriately. Japanese Patent Laying-Open No. 2008-138952 and Japanese Patent Laying-Open No. 2014-47980 disclose a method of detecting scale in a water heating apparatus.

Japanese Patent Laying-Open No. 2008-138952 describes that adhesion of scale is determined based on whether a post-boiling temperature after heating is stopped exceeds a threshold value. Furthermore, Japanese Patent Laying-Open No. 2014-47980 describes that adhesion of scale is determined based on comparing a heat exchanger's heat exchanging efficiency with a threshold value. Japanese Patent Laying-Open No. 2014-47980 provides one threshold value for determination, whereas Japanese Patent Laying-Open No. 2008-138952 employs different threshold values. However, the temperature monitored in Japanese Patent Laying-Open No. 2008-138952 is a post-boiling temperature detected after heating is stopped, rather than temperature detected while a combustion operation is implemented. Accordingly, during combustion, adhesion of scale cannot be determined or an error cannot be output based on the result of such determination. Accordingly, damage such as cracking of the heat exchanger which may arise during combustion cannot be prevented.

SUMMARY OF INVENTION

An object of an aspect with this disclosure is to provide a water heating apparatus and system which detects adhesion of scale appropriately.

A water heating apparatus according to an aspect of this disclosure comprises: a burner; a heat exchanger for heating water with use of heat from the burner; the heat exchanger including a plurality of fins and a tube; a temperature measuring unit for measuring a surface temperature of the heat exchanger; a storage for storing information about the water heating apparatus; and a control unit for controlling the water heating apparatus.

The control unit includes: a scale detection unit for detecting, while the burner provides combustion, occurrence of clogging with scale in the tube; and an output unit for outputting a result of a detection by the scale detection unit, the information including a numerical value representing how many times the surface temperature measured by the temperature measuring unit exceeds at least one of a plurality of threshold values, the scale detection unit is configured such that while the burner provides combustion when the surface temperature measured by the temperature measuring unit exceeds at least one of the plurality of threshold values the scale detection unit adds a predetermined value to the numerical value in the storage and when the numerical value in the storage attains a value equal to or greater than a defined value the scale detection unit detects occurrence of clogging with scale.

Preferably, the control unit is configured to set at least one of the plurality of threshold values variably.

Preferably, the control unit is configured to set at least one of the plurality of threshold values, based on a predetermined type of temperature, variably.

Preferably, the predetermined type of temperature includes a temperature designated by a user.

Preferably, the predetermined type of temperature includes a temperature of hot water from the heat exchanger while the burner provides combustion.

Preferably, the predetermined type of temperature includes a temperature of water supplied to the water heating apparatus.

Preferably, the plurality of threshold values include a first threshold value and a second threshold value larger than the first threshold value. The predetermined value includes a first value to be added when the surface temperature measured is equal to or greater than the first threshold value, and a second value to be added when the temperature measured is equal to or greater than the second threshold value. The second value is larger than the first value.

Preferably, while the burner provides combustion when the surface temperature measured is smaller than any of the plurality of threshold values the scale detection unit subtracts a third value from the numerical value in the storage.

Preferably, the third value is smaller than the predetermined value added to the numerical value in the storage.

Preferably, the water heating apparatus has a cleaning mode for removing scale, and the result of the detection by the scale detection unit includes an error code indicating how many times occurrence of clogging with scale is detected.

Preferably, the information in the storage includes a cumulative time indicating the burner's cumulative combustion time, and the error code includes data indicating the cumulative time.

A water heating system according to another aspect of this disclosure includes a plurality of water heating apparatuses each as described above, and a controller communicating with the plurality of water heating apparatuses to control the plurality of water heating apparatuses. The plurality of water heating apparatuses each further include a communication unit transmitting an error code to the controller, and the controller includes a controller output unit outputting the error code received from each water heating apparatus.

A water heating system according to a still another aspect of this disclosure includes two water heating apparatuses each as described above communicating with each other, and a display device. The output unit includes the display device. One of the two water heating apparatuses includes a communication unit transmitting the error code of one water heating apparatus to the other water heating apparatus, and the control unit of the other water heating apparatus is configured to display on the display device the error code received from one water heating apparatus or the error code of the other water heating apparatus.

The water heating apparatus according to this disclosure detects adhesion of scale in a heat exchanger appropriately.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 16 shows a table 10J which manages an error according to the second embodiment.

FIG. 20 shows a table 10K which manages an error according to the third embodiment.

DESCRIPTION OF THE PREFERRED EMBODIMENTS

Figure 1:
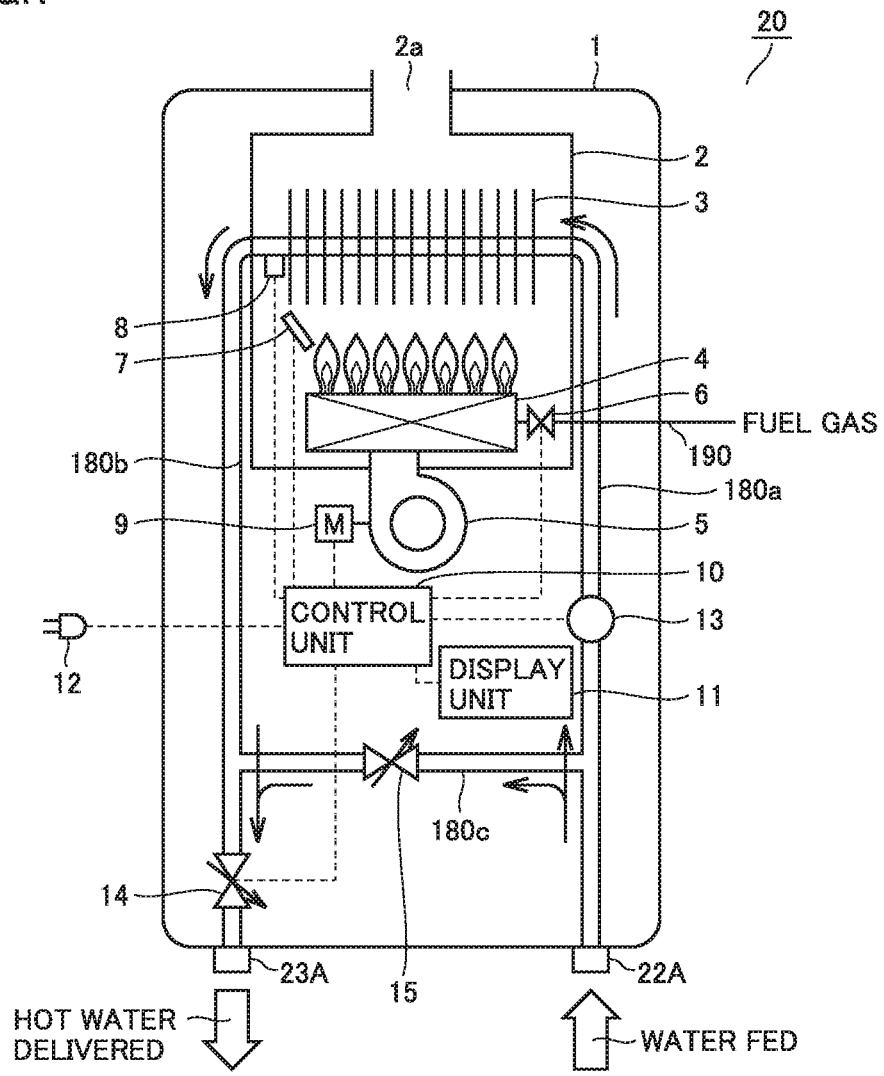
FIG. 1 shows a configuration of a water heating apparatus 20 according to a first embodiment.

The present invention will now be described in embodiments hereinafter in detail with reference to the drawings. The same or corresponding components illustrated in the drawings have the same reference numerals allotted, and details thereof basically will not be repeated.

First Embodiment (Hardware Configuration of the Apparatus)

FIG. 1 represents a configuration of a water heating apparatus 20 according to a first embodiment of the present invention. Referring to FIG. 1, water heating apparatus 20 includes a case 1, a water heater body 2, a water heater body thermistor 8 serving as a temperature sensor, a control unit 10, a display unit 11, a power supply plug 12, a flow rate sensor 13, a flow rate regulating valve 14, pipes 180*a*, 180*b*, 180*c*, and a gas pipe 190. Control unit 10 outputs to each component the electric power supplied to water heating apparatus 20 via power supply plug 12. It should be noted that the arrow illustrated in FIG. 1 indicates a direction of a flow of a fluid. The fluid includes hot water, cold water, and a cleaning liquid in a cleaning mode for cleaning scale of heat exchanger 3.

In case 1, there are arranged water heater body 2, control unit 10, display unit 11, flow rate sensor 13, flow rate regulating valve 14, pipes 180*a*, 180*b*, 180*c*, and the like. In water heater body 2, there are arranged heat exchanger 3, a burner 4, and a blower 5. Water heater body 2 is provided with an exhaust port 2*a*.

Heat exchanger 3 heats fluid including water with use of heat from burner 4, and specifically performs heat exchange with combustion gas generated at burner 4. Heat exchanger 3 adopts a fin and tube type structure which has a plurality of plate-like fins and a heat exchanger tube penetrating the plurality of fins.

Burner 4 is provided for producing combustion gas by combusting a fuel gas.

Gas pipe 190 to which gas valve 6 is attached is connected to burner 4. An ignition plug 7 is arranged above burner 4. When ignition plug 7 is operated to generate a spark between targets provided at burner 4 a fuel-air mixture blown out of burner 4 is ignited by the spark and a flame is generated.

Burner 4 combusts fuel gas that is supplied from gas pipe 190 by the above-mentioned spark to generate a quantity of heat (this will be referred to as a "combustion operation"). The heat generated by the combustion by burner 4 is transmitted through heat exchanger 3 to water flowing through a heat exchanger tube of heat exchanger 3, so that the water is heated.

Blower 5 includes a fan, for example, to supply burner 4 with air required for combustion. The fan is configured to be rotatable by being provided with a driving force by fan motor 9.

Figure 2:
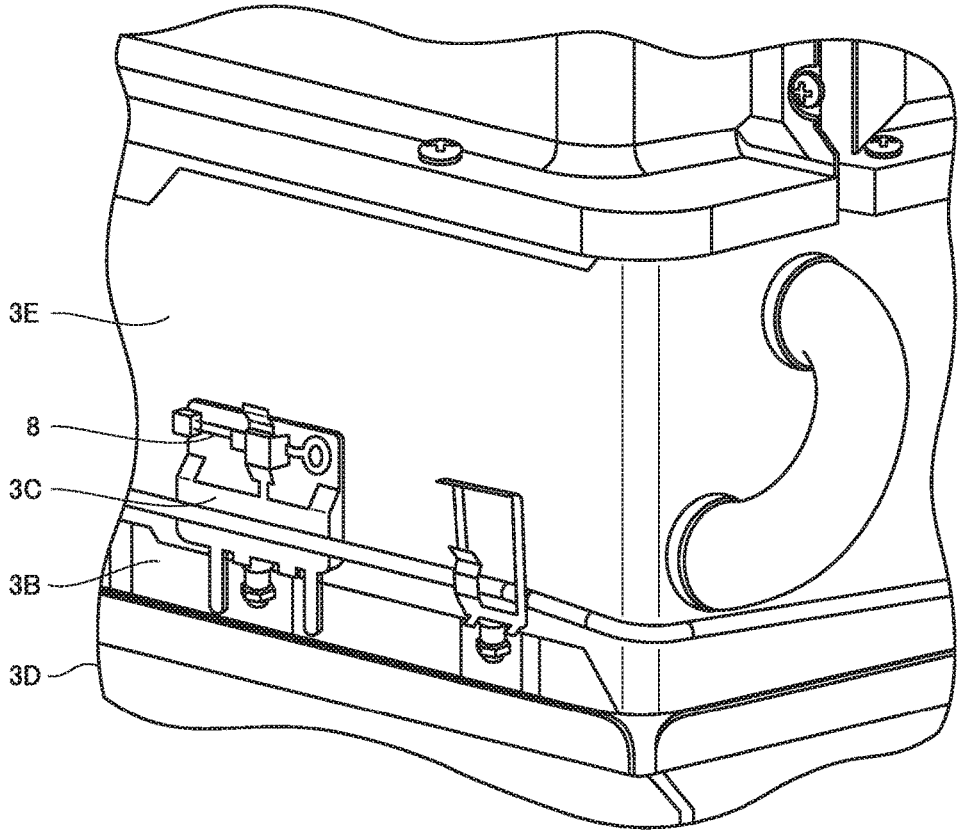
FIG. 2 shows a manner of attaching a water heater body thermistor 8 according to the first embodiment.

Water heater body thermistor 8 is attached to be capable of measuring the temperature of the surface of heat exchanger 3. FIG. 2 shows a manner of attaching water heater body thermistor 8 according to the first embodiment. With reference to FIG. 2, heat exchanger 3 is placed on a burner unit 3D having burner 4 accommodated therein. A flange 3B for fixation is attached to a shell plate 3E of heat exchanger 3. Water heater body thermistor 8 is fixed and attached to shell plate 3E by an attachment plate 3C disposed across flange 3B and shell plate 3E. Water heater body thermistor 8 may be attached to the heat exchanger tube inside heat exchanger 3.

Pipes 180*a*, 180*b*, and 180*c* are pipes for passing the above fluid via heat exchanger 3. More specifically, pipes 180*a*, 180*b*, 180*c* correspond to a water supply pipe 180*a*, a hot water delivery pipe 180*b*, and a bypass pipe 180*c*, respectively. Water supply pipe 180*a* is a pipe for supplying fluid (such as water) from a pipe inlet 22A to heat exchanger 3 (more specifically, to the heat exchanger tube) and is connected to a water supply side of heat exchanger 3. Hot water delivery pipe 180*b* is a pipe for receiving the fluid (such as water) that is delivered from heat exchanger 3, and externally delivering the received fluid via a pipe outlet 23A, and is connected to a hot water delivery side of heat exchanger 3. Bypass pipe 180*c* bypasses fluid including water from water supply pipe 180*a* and guides the water to hot water delivery pipe 180*b*, and it connects water supply pipe 180*a* and hot water delivery pipe 180*b*.

To bypass pipe 180*c*, a bypass flow rate regulating valve 15 is connected. Bypass flow rate regulating valve 15 controls a flow of fluid including water through bypass pipe 180*c*. Flow rate sensor 13 measures an amount of a fluid supplied to heat exchanger 3. Flow rate regulating valve 14 regulates an amount of a fluid delivered from pipe outlet 23A. Flow rate regulating valve 14, and bypass flow rate regulating valve 15 described above also function as a shutoff valve when they are completely closed. Flow rate regulating valve 14 and bypass flow rate regulating valve 15 are controlled in degree of opening for example by a stepping motor.

Display unit 11 is controlled by control unit 10 to display information. The information displayed includes an error indicated when occurrence of clogging with scale is detected etc. In the present embodiment, a case is described where display unit 11 is mounted to water heating apparatus 20. However, display unit 11 may be mounted to a remote control device capable of remotely operating the water heating apparatus. Further, a speaker generating sound or the like may be employed to output information.

Control unit 10 outputs an error to display unit 11 when occurrence of clogging with scale is detected. After the error is output, control unit 10 controls each component to prohibit the combustion operation of burner 4. When control unit 10 receives an operation for starting a cleaning mode, control unit 10 controls each component to start the cleaning mode for cleaning the interior of heat exchanger 3 with a cleaning liquid.

(Functional Configuration)

Figure 3:
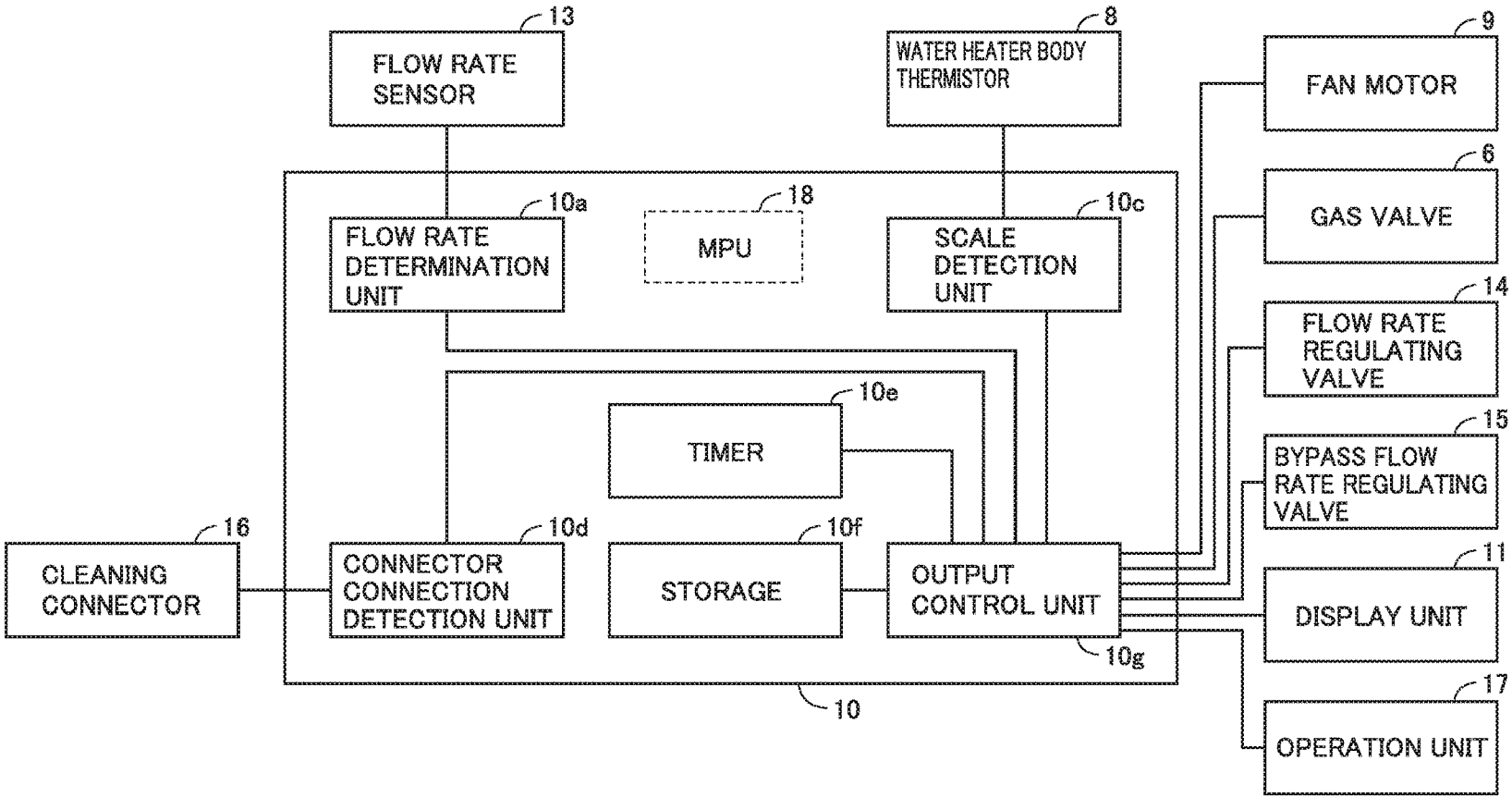
FIG. 3 represents one example of a functional configuration of a control unit 10 of FIG. 1.

FIG. 3 represents one example of a functional configuration of control unit 10. Referring to FIG. 2, control unit 10 includes a flow rate determination unit 10*a*, a scale detection unit 10*c*, a connector connection detection unit 10*d*, a timer 10*e*, a storage 10*f*, and an input/output control unit 10*g*.

Flow rate determination unit 10*a* determines a flow rate of a fluid flowing through a pipe, based on an output of flow rate sensor 13. For example, it is determined whether a flow rate sensed by flow rate sensor 13 indicates a minimum operation quantity (MOQ).

Scale detection unit 10*c* determines whether the temperature measured by water heater body thermistor 8 corresponds to a temperature which indicates occurrence of clogging with scale equal to or greater than a predetermined amount in the tube of heat exchanger 3. Scale detection unit 10*c* receives temperature from water heater body thermistor 8 for example for each second.

Connector connection detection unit 10*d* determines whether a cleaning connector 16, which will be described later, is in a connected state or in a disconnected state (a detached state) by user operation.

Control unit 10 includes an MPU (Micro Processing Unit) 18 (not shown). MPU 18 includes storage 10*f* and timer 10*e*. Storage 10*f* includes volatile and non-volatile storage media such as a ROM (Read Only Memory) and a RAM (Random Access Memory). MPU 18 executes a program stored in storage 10*f* to control each component of water heating apparatus 20.

Flow rate determination unit 10*a*, scale detection unit 10*c*, connector connection detection unit 10*d*, timer 10*e*, and storage 10*f* are electrically connected to input/output control unit 10*g*. Based on information from each of flow rate determination unit 10*a*, scale detection unit 10*c*, connector connection detection unit 10*d*, timer 10*e*, and storage 10*f*, input/output control unit 10*g* outputs commands and signals and the like for controlling operations of fan motor 9, gas valve 6, flow rate regulating valve 14, bypass flow rate regulating valve, display unit 11 and the like. Furthermore, input/output control unit 10*g* connects an operation unit 17 for receiving an instruction of the user to water heating apparatus 20.

Each component in control unit 10 shown in FIG. 3 is implemented by a program executed by MPU 18 or by a combination of the program and a circuit.

Figure 4:
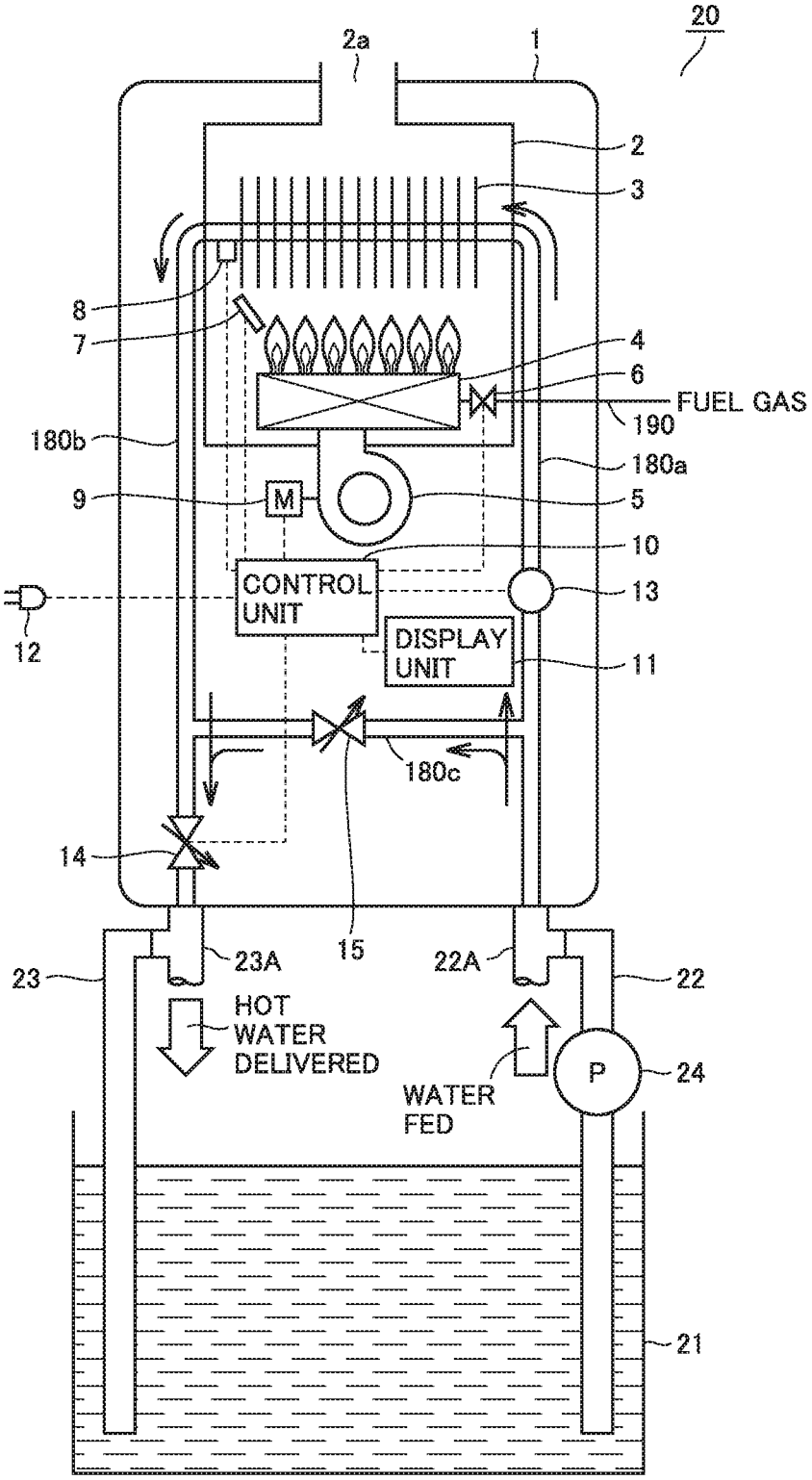
FIG. 4 shows a manner of supplying a cleaning liquid to water heating apparatus 20.
Figure 5:
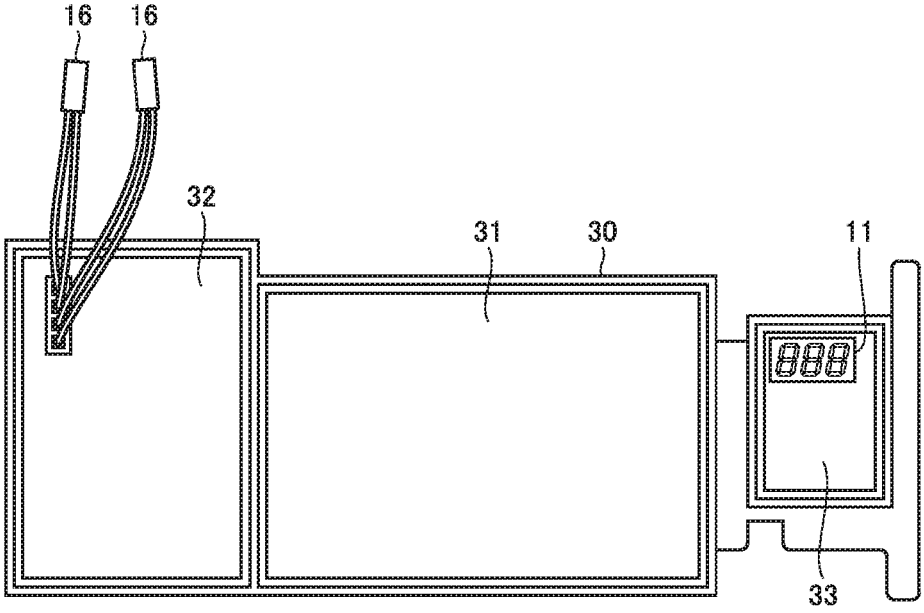
FIG. 5 shows an example of a cleaning connector 16 of FIG. 3.

FIG. 4 shows a manner of supplying a cleaning liquid to water heating apparatus 20. FIG. 5 shows an example of cleaning connector 16 of FIG. 3. With reference to FIG. 5, a controller case 30 is disposed in water heating apparatus 20. In controller case 30, for example, circuit boards 31, 32, and 33 are mounted on which a control circuit of control unit 10, a power supply circuit of a power supply unit, etc. are formed. Cleaning connector 16 is connected for example to circuit board 32 to be electrically connected to a circuit formed on circuit boards 31, 32, and 33.

Cleaning connector 16 has a pair of terminals mutually connectable and disconnectable (or removable) by a user operation. When an operation of the connection or the disconnection is done to cleaning connector 16, a signal of the connection or the disconnection is output to a control circuit or the like formed on circuit boards 31, 32. The operation of the connection of cleaning connector 16 is set as an operation to start the cleaning mode, and the operation of the disconnection of cleaning connector 16 is set as an operation to end the cleaning mode.

(Cleaning Mode)

When control unit 10 starts the cleaning mode, control unit 10 implements cleaning for a predetermined period of time. With reference to FIG. 4, in the cleaning mode, tank 21 which stores a cleaning liquid such as acetic acid for removing scale (of calcium carbonate) is prepared. One open end of pipe 22 is connected to pipe inlet 22A of water heating apparatus 20, and one open end of pipe 23 is connected to pipe outlet 23A of water heating apparatus 20. Pipes 22 and 23 have their respective other open ends located in the cleaning liquid of tank 21. Further, to pipe 22, a pump 24 is connected for delivering the cleaning liquid in tank 21 to heat exchanger 3 through the pipe.

In the cleaning mode, pump 24 is driven. Thus the cleaning liquid in tank 21 flows into the pipe from pipe inlet 22A, passes through the interior of water heating apparatus 20 (more specifically, pipes and heat exchanger 3), and is discharged from pipe outlet 23A into tank 21. The cleaning liquid thus circulates through the interior of water heating apparatus 20 via such a route. Scale adhering to heat exchanger 3 is removed by the circulation of the cleaning liquid.

(Combustion and Mode of Operation)

In the present embodiment, a combustion unit includes burner 4. In the case of stopping (prohibiting) a combustion operation of burner 4, input/output control unit 10*g* controls each component so as to close gas valve 6, stop supplying an electric current to ignition plug 7 (disable ignition), and stop supplying an electric current to fan motor 9 of blower 5 (stop the motor) (this is also referred to as "to implement prohibition of combustion").

In the case of allowing burner 4 to implement combustion, input/output control unit 10*g* controls each component so as to supply an electric current to fan motor 9 (enable motor rotation), open gas valve 6, and pass an electric current to ignition plug 7 (enable ignition) (this is also referred to as "to implement permission for combustion"). Water heating apparatus 20 includes a normal mode which implements permission for combustion and the cleaning mode as modes of operation. In the cleaning mode, prohibition of combustion is implemented.

(Outline of Determination of Occurrence of Clogging with Scale)

In the first embodiment, a cumulative value CN is stored in storage 10*f* for determination of clogging with scale. In the normal mode while the combustion operation is performed whenever scale detection unit 10*c* determines that the temperature measured by water heater body thermistor 8 exceeds at least one of a plurality of threshold values, scale detection unit 10*c* adds a predetermined value to cumulative value CN in storage 10*f*. Accordingly, cumulative value CN in storage 10*f* indicates a value (a numerical value) corresponding to how many times it is determined that the temperature measured by water heater body thermistor 8 exceeds at least one of the plurality of threshold values. Scale detection unit 10*c* determines occurrence of clogging with scale when cumulative value CN in storage 10*f* is equal to or greater than a defined value.

When scale adheres to heat exchanger 3, heat transfer efficiency decreases and the amount of heat transferred to water decreases. (Accordingly, the quantity of heat possessed by heat exchanger 3 increases, which increases a post boiling temperature presented when the hot water supply operation is stopped.) Accordingly, it can be estimated that there is a larger amount of adhering scale when water heater body thermistor 8 measures higher temperature. In the present embodiment, in view of such a background, scale detection unit 10*c* compares the temperature measured by water heater body thermistor 8 with the plurality of threshold values, and determines the extent of clogging with scale (the amount of adhering scale) based on a result of the comparison.

(Process Flow Chart)

Figure 6:
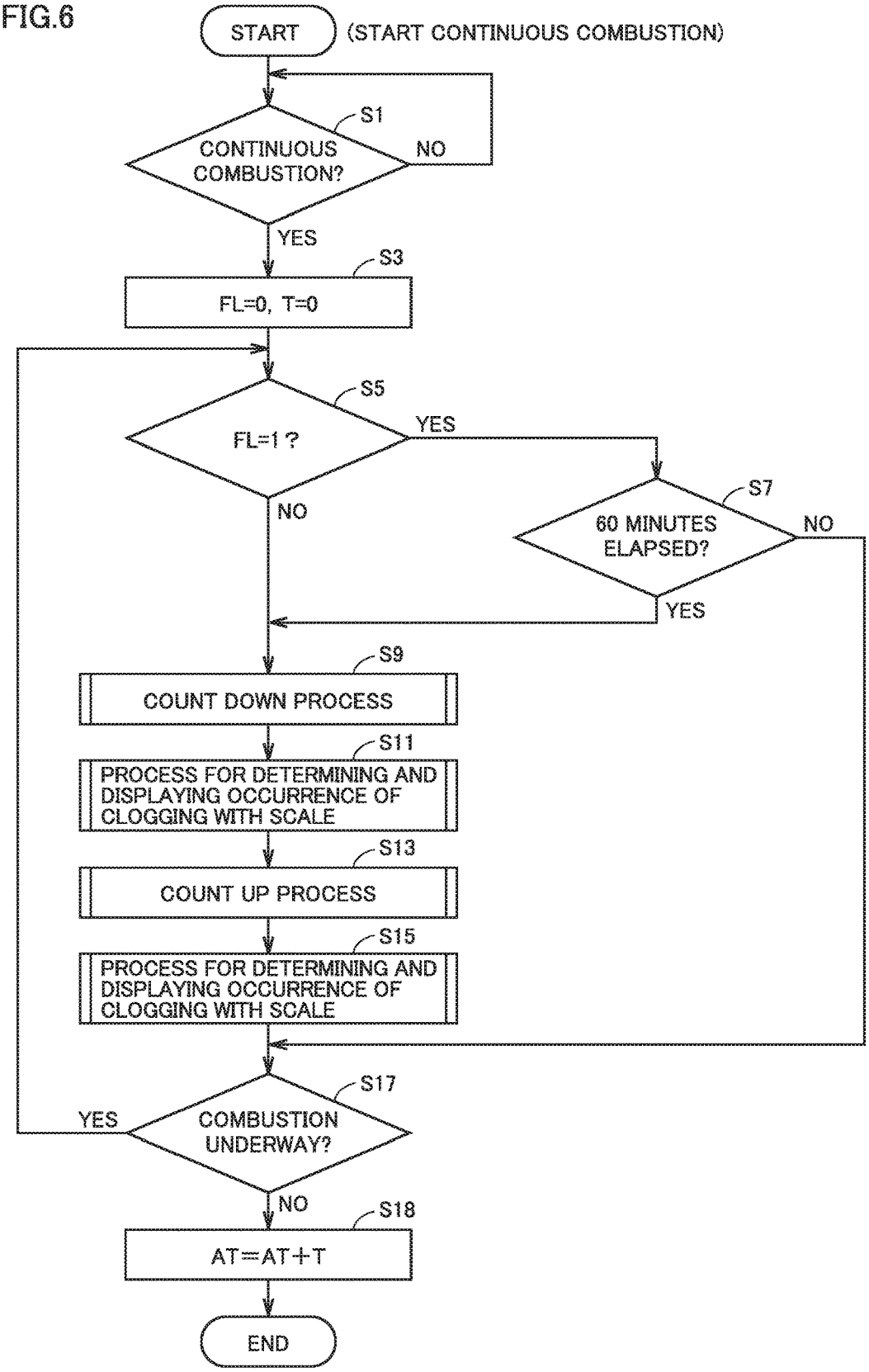
FIG. 6 is a flowchart generally indicating an overall process according to the first embodiment.
Figure 7:
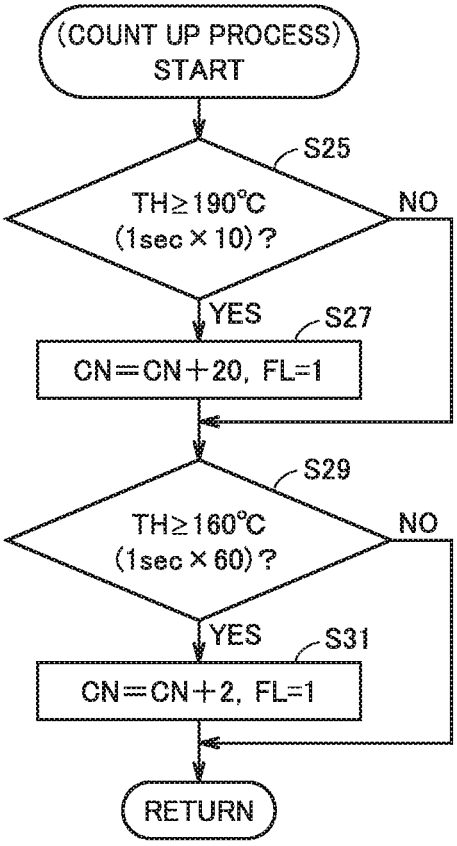
FIG. 7 is a flowchart of a count-up process according to the first embodiment.
Figure 8:
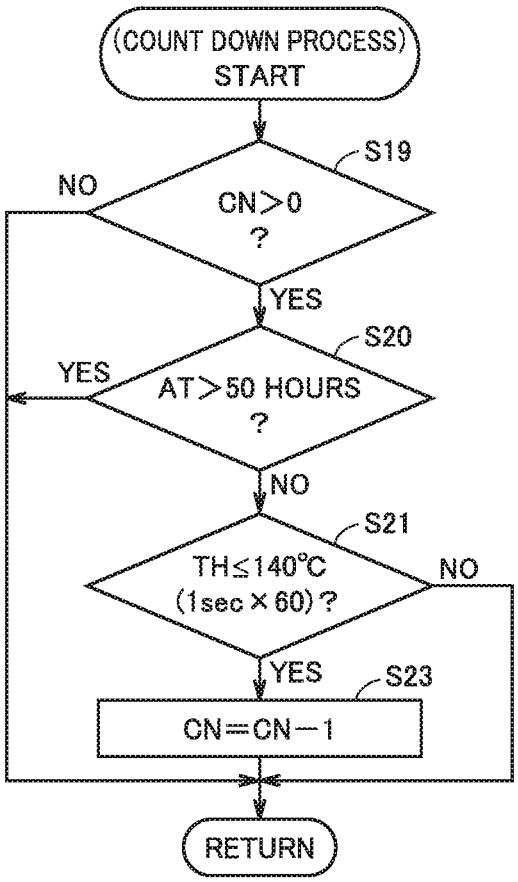
FIG. 8 is a flowchart of a countdown process according to the first embodiment.
Figure 9:
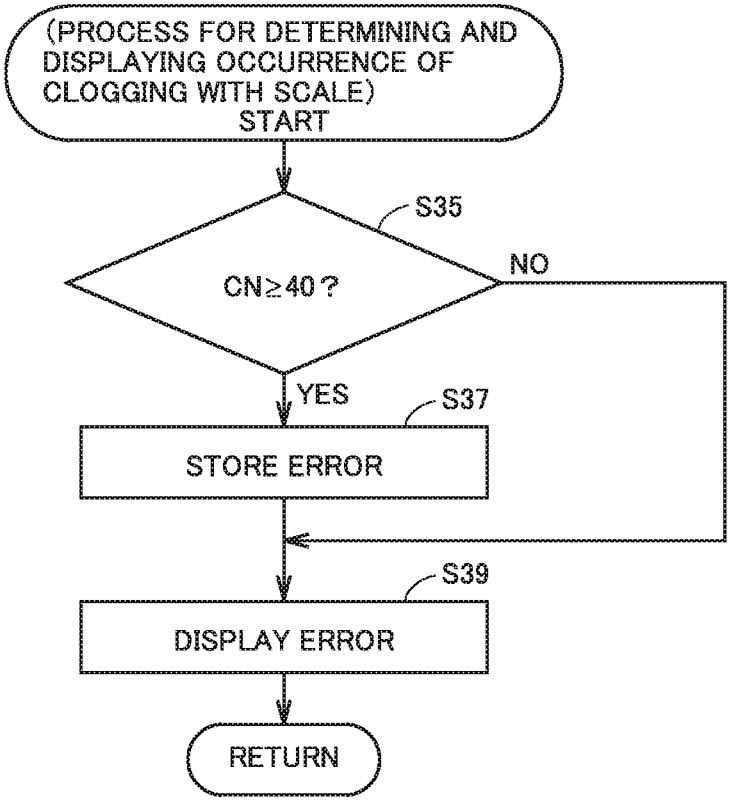
FIG. 9 is a flowchart of a process for determining and displaying clogging with scale according to the first embodiment.

FIG. 6 is a flowchart generally indicating an overall process according to the first embodiment. FIG. 7 is a flowchart of a count-up process according to the first embodiment. FIG. 8 is a flowchart of a countdown process according to the first embodiment. FIG. 9 is a flowchart of a process for determining and displaying clogging with scale according to the first embodiment. A program and data for processes in accordance with these flow charts are stored in advance in storage 10*f*. The processes are implemented by the control unit 10 MPU 18 executing the program.

In the processes of FIG. 6-FIG. 8, variables of a cumulative time AT, a flag FL, a combustion time T, a temperature TH, and cumulative value CN as described above are used. Cumulative time AT indicates a value of a cumulative time for which the combustion operation was implemented in water heating apparatus 20. Flag FL indicates whether temperature TH exceeds a threshold value (or cumulative value CN is counted up) in the combustion operation. Combustion time T indicates a period of time for which, per combustion operation, that combustion operation is performed. Temperature TH indicates a temperature measured by water heater body thermistor 8. These variables are stored in a predetermined region of storage 10*f*.

Initially, when power supply plug 12 of water heating apparatus 20 is inserted to a power supply outlet (not shown) to start supplying water heating apparatus 20 with power, the normal mode starts. When MOQ is detected in the normal mode in a state of permission for combustion, control unit 10 starts the combustion operation. Once the combustion operation has been started, control unit 10 starts the process of FIG. 6.

With reference to FIG. 6, control unit 10 determines whether the combustion operation is continuous combustion (step S1). Specifically, whether the combustion operation is continuous combustion is determined, based on whether the combustion operation (or detection of MOQ) continues for a predetermined period of time (for example of 2 minutes).

While it is not determined that the combustion operation is continuous combustion (NO at step S1), step S1 is repeated, whereas when it is determined that the combustion operation is continuous combustion (YES at step S1), control unit 10 sets flag FL and combustion time T to 0 (step S3).

Control unit 10 determines whether the condition of (FL=1) is established (step S5). At the time, flag FL=0, and accordingly, it is determined that the condition is not established (NO at step S5), and a countdown process (step S9), a count-up process (step S12), a process for determining and displaying occurrence of clogging with scale (steps S11 and S15) are implemented, as will be described hereinafter.

In the countdown process, a predetermined value is subtracted (or counted down) from cumulative value CN. In the count-up process, a predetermined value is added (or counted up) to cumulative value CN.

The process for determining and displaying occurrence of clogging with scale implements a process for determining occurrence of clogging of scale based on cumulative value CN, and a process for displaying an error based on a result of that determination. Herein, the error includes information for urging a user to implement the cleaning mode.

Subsequently, control unit 10 determines whether the combustion operation is currently performed (step S17). When MOQ is no longer detected, the combustion operation ends. Accordingly, based on whether MOQ is detected or not, whether the combustion operation is currently performed is determined.

When it is determined that the combustion operation is currently performed (YES at step S17), the control returns to step S5 and the subsequent steps will be repeated. When it is determined that the combustion operation has ended (NO at step S17), control unit 10 calculates the current combustion time T (a period of time having elapsed since the combustion operation was started) and adds combustion time T as calculated to cumulative time AT (step S18). Thus, whenever a combustion operation ends, combustion time T is added to cumulative time AT to allow cumulative time AT to indicate the latest cumulative time. Note that control unit 10 calculates combustion time T based on an output of timer 10*e*.

In the above count-up process (step S13), whenever temperature TH exceeds a threshold value and an addition to cumulative value CN is implemented, flag FL is set to 1. Based on the output of timer 10*e*, control unit 10 stores the latest time at which flag FL is set to 1. This time will also be referred to as "the latest time". When it is determined that the condition of (FL=1) is established (YES at step S5), the control moves to step S7.

In step S7, control unit 10 determines, based on the output of timer 10*e*, whether a predetermined period of time (for example of 60 minutes) has elapsed since the "latest time." When it is determined that the predetermined period of time has elapsed (YES at step S7), the control moves to step S9, whereas when it is determined that the predetermined period of time has not elapsed (NO at step S7), the control moves to step 17. Accordingly, during the combustion operation when flag FL is set to 1, then, whenever a predetermined period of time (for example of 60 minutes) elapses, the countdown process, the count-up process, and the process for determining occurrence of clogging of scale are implemented.

(Count-Up Process)

With reference to FIG. 7, the process for counting up cumulative value CN will be described. Scale detection unit 10*c* determines whether a period of time for which temperature TH from water heater body thermistor 8 is 190° C. or more continues for 10 seconds (step S25). The temperature of 190° C. is an example of a temperature serving as a threshold value for determining that there is a large amount of adhering scale, and it is previously obtained through an experiment.

When scale detection unit 10*c* determines that a period of time for which temperature TH is 190° C. or more continues for 10 seconds (YES at step S25), scale detection unit 10*c* adds 20 to cumulative value CN and sets flag FL to 1 (step S27).

When scale detection unit 10*c* determines that a period of time for which temperature TH is 190° C. or more does not continue for 10 seconds (NO at step S25), scale detection unit 10*c* determines whether a period of time for which temperature TH is 160° C. or more continues for 60 seconds (step S29). The temperature of 160° C. is an example of a temperature serving as a threshold value for determining that scale starts to adhere to heat exchanger 3 (or there is a small amount of adhering scale), and it is previously obtained through an experiment.

When scale detection unit 10*c* determines that a period of time for which temperature TH is 160° C. or more continues for 60 seconds (YES at step S29), scale detection unit 10*c* adds 2 to cumulative value CN and sets flag FL to 1 (step S31). Subsequently, the count-up process ends and the control returns to the process of FIG. 6.

Thus, cumulative value CN is such that temperature TH of heat exchanger 3 is compared with a threshold value (190° C. and 160° C.) for determining adhesion of scale and cumulative value CN is counted up based on a result of the comparison. Accordingly, cumulative value CN indicates whether there is scale adhering to heat exchanger 3.

Furthermore, the above threshold value includes a threshold value (160° C.) for determining that there is a small amount of adhering scale and a threshold value (190° C.) for determining that there is a large amount of adhering scale (i.e., that there is a large possibility that heat exchanger 3 will be damaged by the scale). Corresponding to each threshold value, weighting regarding a value added to cumulative value CN varies. Accordingly, cumulative value CN indicates a degree of an amount of scale adhering to heat exchanger 3.

Furthermore, regarding the above weighting, scale detection unit 10*c* varies a value added to cumulative value CN and a period of time for which a threshold temperature should continuously be measured (i.e., a grace period after a measured temperature exceeds a threshold value before an addition is performed) to correspond to each threshold value. Specifically, a value added to cumulative value CN based on the result of the determination by a threshold value (190° C.) (i.e., "20") is set to be larger than a value added based on the result of the determination by another threshold value (160° C.) (i.e., "2"). Furthermore, a grace period of time before a value is added to cumulative value CN, based on the result of the determination by a threshold value (190° C.) (i.e., 10 seconds), is set to be shorter than a grace period of time before a value is added to cumulative value CN, based on the result of the determination by another threshold value (160° C.) (i.e., 60 seconds).

By such weighting, a time required after scale adhesion is detected before an error is output can be changed depending on the amount of adhering scale. Specifically, when it is determined that temperature TH is 160° C. to 190° C., i.e., when it is determined that there is a small amount of adhering scale, the required time can be increased, whereas when it is determined that temperature TH attains 190° C. or higher, i.e., when it is determined that there is a large amount of adhering scale, the required time can be decreased.

(Countdown Process)

With reference to FIG. 8, the process for counting down cumulative value CN will be described. Control unit 10 determines whether the condition of (CN>0) is established (step S19). When control unit 10 determines that this condition is not established (NO at step S19), it returns to the process of FIG. 6 without performing the countdown process. When control unit 10 determines that the condition of (CN>0) is established (YES at step S19), control unit 10 determines whether cumulative time AT exceeds 50 hours (step S20). When it is determined that cumulative time AT exceeds 50 hours (YES at step S20) it returns to the process of FIG. 6 without performing the countdown process.

When it is determined that cumulative time AT does not exceed 50 hours (NO at step S20), scale detection unit 10*c* determines whether a period of time for which temperature TH is equal to or less than 140° C. continues for 60 seconds (YES at step S21).

When scale detection unit 10*c* determines that a period of time for which temperature TH is equal to or less than 140° C. does not continue for 60 seconds (NO at step S21), the countdown process ends and the control returns to the process of FIG. 6. When scale detection unit 10*c* determines that a period of time for which temperature TH is equal to or less than 140° C. continues for 60 seconds (YES at step S21), scale detection unit 10*c* subtracts a predetermined value, e.g., 1, from cumulative value CN (step S23). Subsequently, the countdown process ends and the control returns to the process of FIG. 6. Note that, desirably, the value subtracted from cumulative value CN is smaller than the value added to cumulative value CN by the above count-up process.

Thus, when in the above count-up process temperature TH of 160° C. or more or 190° C. or more is measured and a value (2 or 20) is added to cumulative value CN, and thereafter a period of time for which temperature TH is 140° C. or less continues for 60 seconds, the process for subtraction from cumulative value CN is performed. Thus, when temporarily high temperature TH is measured accordingly and a process for addition to cumulative value CN is performed, the countdown process to return cumulative value CN to an original value can be performed. This can avoid a situation where temperature TH of 160° C. or more or 190° C. or more is erroneously measured due to noise etc., resulting in determining that clogging with scale has occurred and accordingly outputting an error.

(Process for Determining and Displaying Occurrence of Clogging with Scale)

With reference to FIG. 9, a process for determining occurrence of clogging of scale based on cumulative value CN, and displaying an error, will be described. Herein, data ED which indicates an error is stored in storage 10*f* at a table 10H (see FIG. 10A and FIG. 10B). Table 10H will be described later.

With reference to FIG. 9, scale detection unit 10*c* determines whether a condition for determining occurrence of clogging with scale, or CN≥40, is established (Step S35). It should be noted that the threshold value "40" is one example and is not exclusive.

When scale detection unit 10*c* determines that the condition is established (YES at step S35), control unit 10 sets a code of an error in data ED, and stores data ED with the code set to table 10H of storage 10*f* (step S37). Output control unit 10*g* controls display unit 11 to display the code of data ED stored in table 10H (step S39).

When scale detection unit 10*c* determines that the condition of CN≥40 is not established (NO at step S35), the above display process is not performed and the process of FIG. 9 ends. After that, the control returns to the process of FIG. 6.

According to the process of FIG. 9, an error is displayed when cumulative value CN calculated by the count-up process exceeds the threshold value of occurrence of clogging with scale. The user can confirm the error to know that a time has arrived to perform the cleaning mode.

(Error and Table)

In the first embodiment, whenever occurrence of clogging with scale is determined (in other words, whenever CN≥40 is determined), control unit 10 sets a two-digit code in data ED. The code set in data ED varies sequentially, i.e., C1→C2→C3→C4→CF, whenever occurrence of clogging with scale is determined. When occurrence of clogging with scale is determined five times or more, the code is maintained with "CF". Thus, the two-digit code set in data ED can represent how many times an error is generated.

Figure 10A:
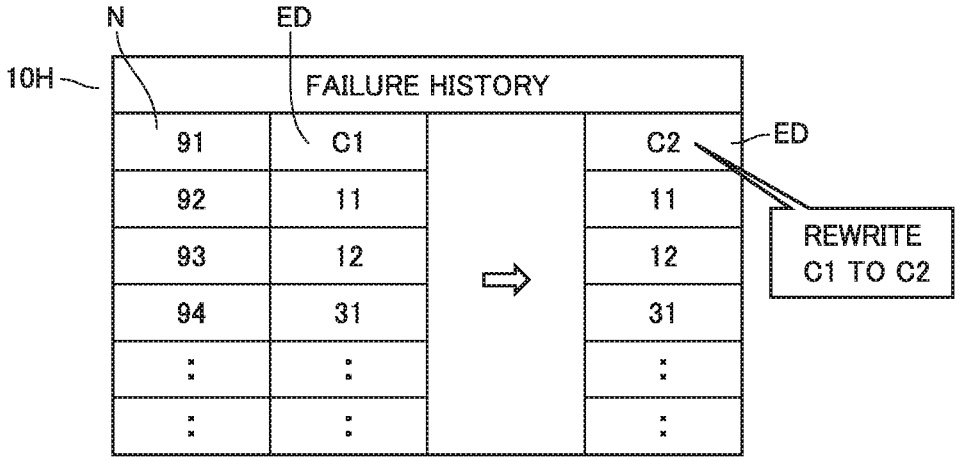
FIG. 10A and FIG. 10B show a table 10H according to the first embodiment.
Figure 10B:
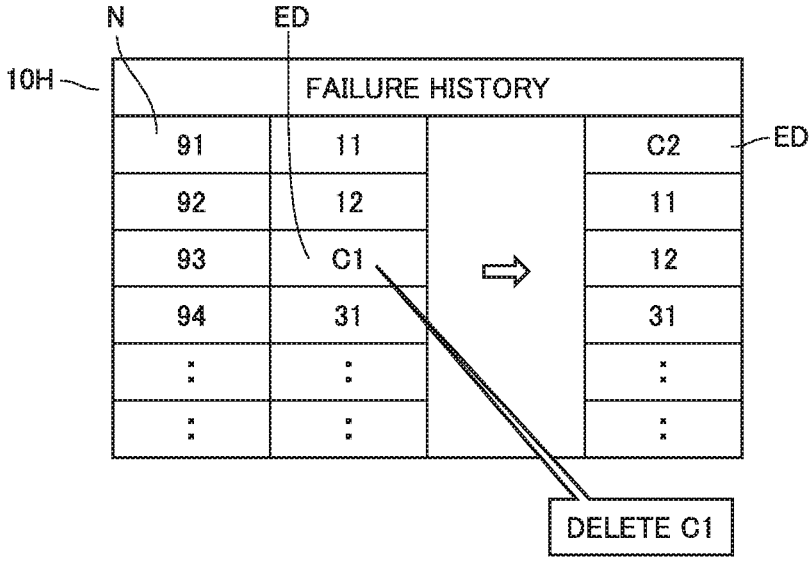

FIG. 10A and FIG. 10B show a table 10H in which an error is stored according to the first embodiment. Table 10H is stored in storage 10*f* at a nonvolatile region. In table 10H, data ED is each stored in association with a failure history number N. Table 10H has a structure of a single type of ring buffer which can store a maximum of eight pieces of data ED. Accordingly, in table 10H, data ED that is the oldest (or generated earliest in the past) is overwritten with data ED that is the latest (or generated latest).

FIG. 10A shows a case in which data ED of clogging with scale generated for a first time (code "C1") is stored in table 10H and thereafter an error of clogging with scale for a second time is generated. In this case, data ED of the second time (code "C2") is stored in table 10H by rewriting the code of data ED of occurrence of clogging with scale that is previously stored from "C1" to "C2". Furthermore, in place of the above rewriting, as shown in FIG. 10B, data ED of clogging with scale for the first time previously stored in table 10H may be deleted and data ED of the second time (code "C2") may be stored in table 10H.

Thus, in table 10H, regarding the error indicating occurrence of clogging with scale, only the code of the error latest generated is stored. Thus, when a code of data ED stored in table 10H indicating occurrence of clogging with scale is displayed (step S43), how many times it is determined that clogging with scale has occurred can be output.

(Example of Displaying)

Figures 11A, 11B, 11C:
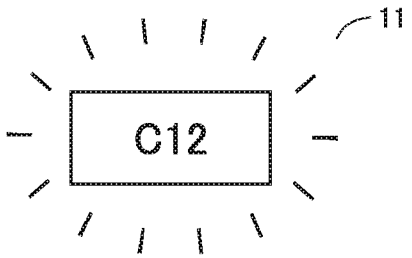
FIG. 11A, FIG. 11B, and FIG. 11C are diagrams for illustrating displaying of an error according to the first embodiment.

FIG. 11A, FIG. 11B, and FIG. 11C are diagrams for illustrating displaying of an error according to the first embodiment by way of example. FIG. 11A indicates a case where a 3-digit code is displayed. The 3-digit code is configured by adding a single digit to the end of the 2-digit code indicating an error as described above (i.e., C1, C2, C3, C4, and CF3). Of the 3-digit code, a numerical value of the single digit at the end represents cumulative time AT. An association of cumulative time AT with the 1-digit code (the numerical value) is indicated in a table 10G of FIG. 11B. Note that table 10G is stored in storage 10*f*.

For example, when control unit 10 displays a code "C1" of table 10H (Step S47), control unit 10 searches table 10G, based on cumulative time AT. For example, when cumulative time AT indicates 510 hours, control unit 10 reads "2" from table 10G as the 1-digit code by the search. Output control unit 10*g* combines the above 2-digit code "C1" with the code "2" that is read from table 10G to generate a 3-digit code "C12". Output control unit 10*g* controls display unit 11 based on code "C12" thus generated. Thus, display unit 11 displays "C12" (see FIG. 11C).

Thus, displaying as shown in FIG. 11C can indicate information of how many times clogging with scale has occurred (in this example, once) and cumulative time AT provided at a point of time at which clogging with scale occurs.

Note that in the first embodiment the threshold value for the counting up or counting down (i.e., 160° C., 190° C., and 140° C.) is not exclusive. Note, however, that the threshold value for the countdown process (i.e., 140° C.) is lower than the threshold value of the count-up process (i.e., 160° C.). Furthermore, the weighting value (the value added to cumulative value CN (i.e., 2 or 20)), the grace period of time before an addition is performed (i.e., 60 seconds or 10 seconds), and the threshold value for determining occurrence of clogging with scale (i.e., "40") are one example and they are not limited to such values. Furthermore, these values may be set variably depending on the properties of the water supplied to water heating apparatus 20, cumulative time AT, and the like. For example, the user can operate a switch (not shown) of water heating apparatus 20 to change these values.

Furthermore, each water heating apparatus 20 may be adapted to output an error indicating occurrence of clogging with scale by flashing on and off a light emitting diode (LED) (not shown) together with displaying the error by display unit 11 as described above or separately from doing so.

Second Embodiment

A second embodiment indicates an exemplary variation of the first embodiment. In the second embodiment is indicated a method of determining occurrence of clogging with scale and outputting an error in a water heating system 110 including a plurality of coupled water heating apparatuses 20 (hereinafter also referred to as a multi-coupled-type water heater) and a controller 100 which controls the plurality of water heating apparatuses 20.

Figure 12:
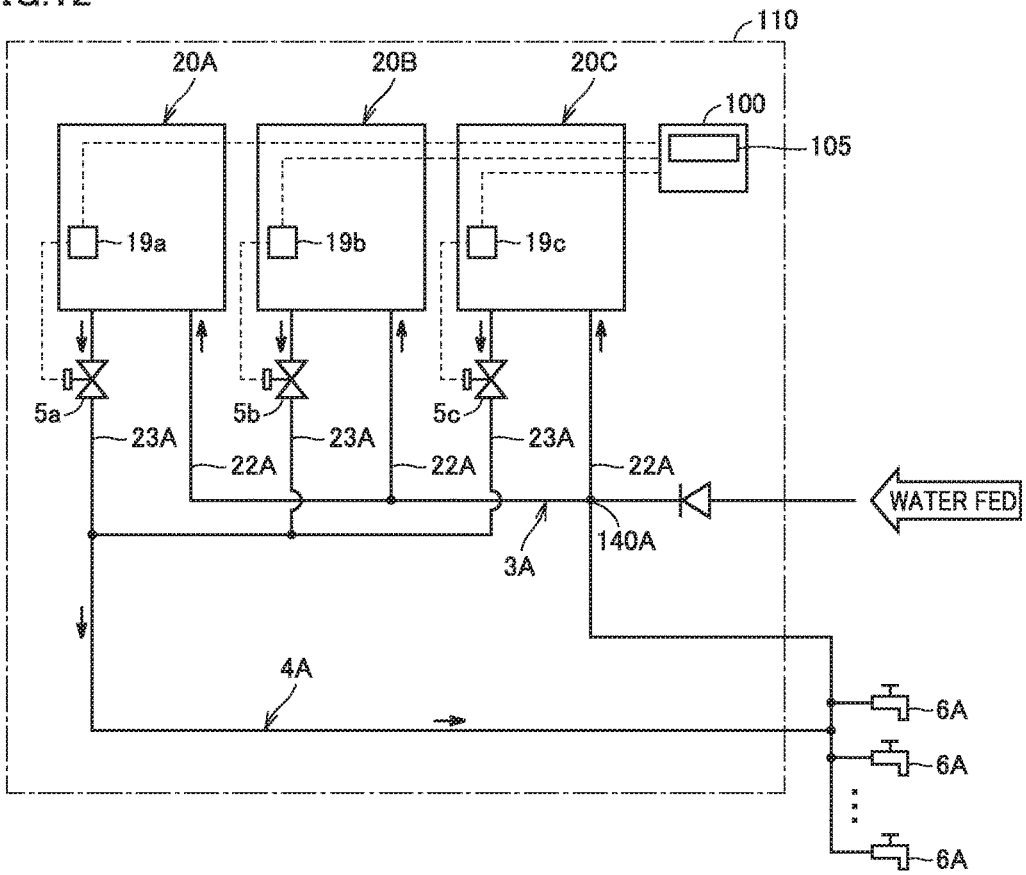
FIG. 12 is a schematic configuration diagram of a water heating system 110 according to a second embodiment.

FIG. 12 shows water heating system 110 according to the second embodiment. Water heating system 110 includes a multi-coupled-type water heater and controller 100 which controls the multi-coupled-type water heater. The multi-coupled-type water heater includes a plurality of water heating apparatuses 20A, 20B, and 20C coupled via a common hot water supply path. Water heating system 110 further includes a water supply pipe 3A for supplying water to pipe inlet 22A of water heating apparatuses 20A, 20B and 20C, and a hot water supply pipe 4A for delivering water from water heating apparatuses 20A, 20B and 20C to an external hot water tap (hot water supply faucet) 6A. Hot water supply pipe 4A is connected to pipe outlet 23A of each water heating apparatus 20A, 20B, 20C via electromagnetically opened/closed valves 5*a*, 5*b*, and 5*c*. When hot water tap 6A is opened, the water from each water heating apparatus is delivered from hot water tap 6A via hot water supply pipe 4A.

Valves 5*a*, 5*b*, and 5*c* are opened/closed as controlled by controller 100. Opening valves 5*a*, 5*b*, 5*c* allows water to enter from water supply pipe 3A to the respective water heating apparatuses and be output from the respective water heating apparatuses to hot water supply pipe 4A.

Water heating apparatuses 20A, 20B, and 20C include controllers 19*a*, 19*b*, and 19*c* which control the water heating apparatuses, respectively. Each controller 19*a*, 19*b*, and 19*c* communicates with controller 100 via a communication cable. Each water heating apparatus 20A, 20B, and 20C receives a command from controller 100, and performs operation according to the received command. Hereinafter, when water heating apparatuses 20A, 20B, and 20C are collectively referred to, they will be referred to as water heating apparatus 20. Furthermore, when controllers 19*a*, 19*b*, and 19*c* are collectively referred to, they will be referred to as controller 19. Note that although the multi-coupling type water heater is configured of three water heating apparatuses 20 in FIG. 12, the water heating apparatuses are not limited to three water heating apparatuses and any number thereof that is more than one can be used. Each water heating apparatus 20A, 20B, 20C has a basic hardware configuration and a configuration in the cleansing mode and operates for determining occurrence of clogging with scale and outputting an error, similarly as has been indicated in the first embodiment, and accordingly, they will not be repeated in that regard in detail.

Figure 13:
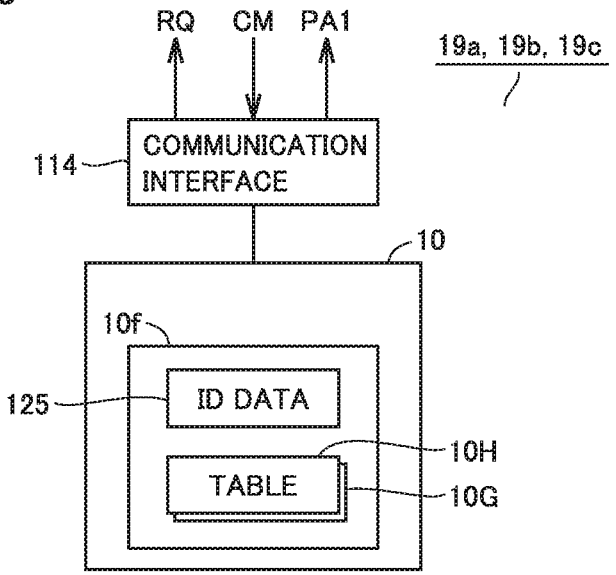
FIG. 13 shows a configuration of a controller 19 according to the second embodiment.

FIG. 13 shows a configuration of controller 19 according to the second embodiment. Controller 19 includes control unit 10 and the like of FIG. 3, and in addition, a communication interface 114 for communicating with controller 100. Storage 10*f* stores ID data 125 for identifying water heating apparatus 20 of interest, and tables 10H and 10G indicated in the first embodiment. Communication interface 114 receives a complement request RQ and a packet PA1, which will be described later, from control unit 10 and transmits them to controller 100, and also receives an operation start command CM from controller 100. Complement request RQ indicates a request for a water heating apparatus to complement its hot water supply capability when it operates.

Figure 14:
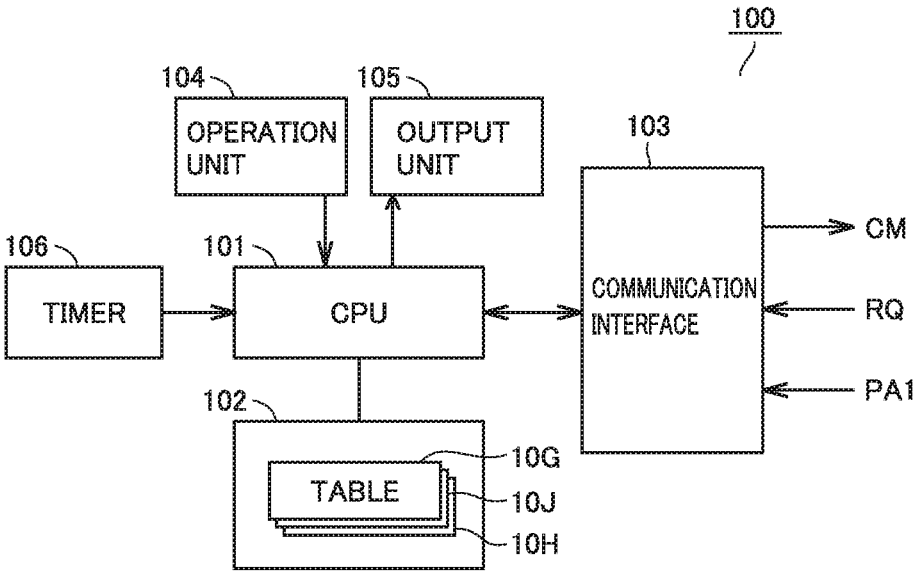
FIG. 14 shows a configuration of a controller 100 according to the second embodiment.

FIG. 14 shows a configuration of controller 100 according to the second embodiment. Controller 100 includes a CPU (a central processing unit) 101, a storage 102, a communication interface 103 for communicating with each water heating apparatus 20, an operation unit 104 for receiving a user operation, an output unit 105 for outputting information regarding an operation of the entire multi-coupled-type water heater or an operation of each water heating apparatus 20, and a timer 106. Output unit 105 includes a display which displays an image, or an audio device which outputs sound, etc. Communication interface 103 receives operation start command CM from CPU 101 and transmits it to each water heating apparatus 20, and also receives from each water heating apparatus 20 complement request RQ and packet PA1 described later.

Storage 102 includes volatile and non-volatile storage media such as a ROM (Read Only Memory) and a RAM (Random Access Memory). CPU 101 executes a program stored in storage 102 to control each component of water heating system 110. Furthermore, storage 102 stores table 10J of FIG. 16 described later, and tables 10H and 10G indicated in the first embodiment.

When the multi-coupled-type water heater starts a hot water supply operation, controller 100 controls one of the plurality of water heating apparatuses 20 as a main water heating apparatus that starts the operation, and the other water heating apparatus(es) 20 as a subordinate water heating apparatus(es). When controller 100 receives complement request RQ from the main water heating apparatus, controller 100 transmits operation start command CM to a sub water heating apparatus. In response to operation start command CM, the sub water heating apparatus starts operation (the combustion operation).

Figure 15:
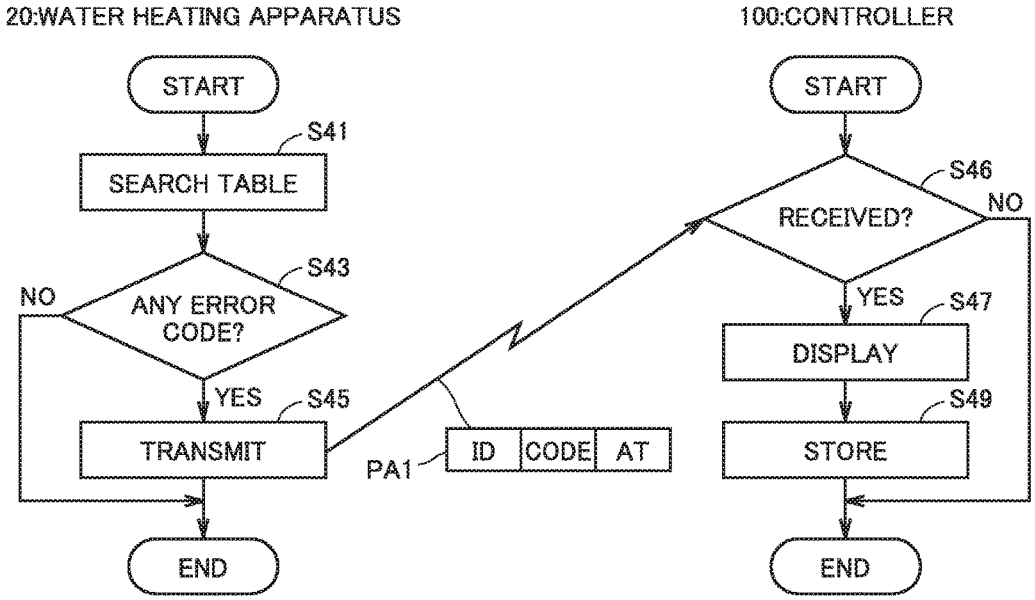
FIG. 15 is a flowchart of a process for outputting an error according to the second embodiment.
Figure 17:
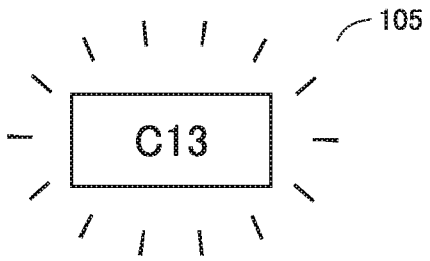
FIG. 17 shows an example of outputting an error by an output unit 105 according to the second embodiment.

While in the first embodiment the error indicating clogging of water heating apparatus 20 with scale is output to display unit 11, in the second embodiment, the error is output to output unit 105 of controller 100 in place of display unit 11 or as well as display unit 11. With reference to FIG. 15-FIG. 17, a process for outputting an error indicating occurrence of clogging with scale in water heating system 110 will be described. FIG. 15 is a flowchart of a process for outputting an error. A program according to the processing flow of FIG. 15 is stored in storage 102 of controller 100, and storage 10*f* of water heating apparatus 20. When CPU 101 executes the program of storage 102, and furthermore, MPU 18 of control unit 10 executes the program of storage 10*f*, the process of FIG. 15 is implemented.

FIG. 16 shows a table 10J which manages an error according to the second embodiment. Table 10J includes ID data 125, a 2-digit code indicating an error and cumulative time AT in association with one another for each water heating apparatus 20 from which an error indicating occurrence of clogging with scale is detected. FIG. 17 shows an example of outputting an error by output unit 105 according to the second embodiment.

With reference to FIG. 15, control unit 10 of water heating apparatus 20 searches table 10H periodically (step S41). As a result of the search, control unit 10 determines whether error ED indicating occurrence of clogging with scale is registered in table 10H (step S43). When the error is not registered (No at step S43), control unit 10 ends the process.

When control unit 10 determines that error ED indicating occurrence of clogging with scale is registered (YES at step S43) control unit 10 reads the 2-digit code of that error ED from table 10H. Control unit 10 generates packet PA1 having the read code stored therein, and transmits packet PA1 to controller 100 (step S45). After that, the process ends.

Packet PA1 includes ID data 125 stored in storage 10*f*, a 2-digit code representing an error indicating occurrence of clogging with scale, and data of cumulative time AT, as shown in FIG. 15.

The process of FIG. 15 on the side of controller 100 is performed periodically. Once the process is started, CPU 101 determines whether packet PA1 is received from water heating apparatus 20 (step S46). When CPU 101 determines that packet PA1 is not received (NO at step S46), CPU 101 ends the process, whereas when CPU 101 determines that packet PA1 has been received (YES at step S46), CPU 101 generates display data based on the contents of packet PA1 received, and controls output unit 105 based on the generated display data (step S47). Thus, output unit 105 displays an image according to the error code of packet PA1 (see FIG. 17).

Specifically, CPU 101 searches table 10G (see FIG. 11B) based on the data of cumulative time AT in packet PA1. By the search, a code of the lowest digit corresponding to a period of time which cumulative time AT of interest indicates is read from table 10G. CPU 101 generates display data of the 2-digit error code of packet PA1 and the code read from table 10G combined together. For example, when packet PA1 has an error code of "C1" and a code "3" is read from table 10G, output unit 105 displays "C13" (see FIG. 17).

Thus, controller 100 can indicate for each water heating apparatus 20 a code of an error indicating occurrence of clogging with scale (i.e., how many times clogging with scale has occurred) and cumulative time AT. Note that CPU 101 may read ID data 125 from packet PA1 and output ID data 125 that is read via output unit 105. In that case, an error code and the information of cumulative time AT can be indicated together with the identifier of water heating apparatus 20.

CPU 101 stores to table 10J the contents of packet PA1 received (step S49). Specifically, CPU 101 determines, based on ID data 125 of packet PA1, whether the same ID data as ID data 125 of interest is stored in table 10J. When it is not stored, CPU 101 associates ID data of packet PA1, the code of the error indicating occurrence of clogging with scale, and cumulative time AT with one another and stores them to table 10J.

In contrast, when the same ID data as ID data 125 of packet PA1 is stored in table 10J, the data associated with the ID data in table 10J is overwritten with the error code and cumulative time AT of packet PA1 received. Thus, controller 100 can manage for each water heating apparatus 20 of water heating system 110 a code of an error indicating occurrence of clogging with scale (i.e., how many times the error has occurred) and cumulative time AT.

Note that, rather than transmitting cumulative time AT, water heating apparatus 20 may be adapted to transmit to controller 100 a code obtained by searching table 10G of storage 10*f*. In that case, controller 100 can omit the step of searching table 10G of storage 102.

As shown in FIG. 17, when output unit 105 displays only the code of water heating apparatus 20, the code of water heating apparatus 20 for which Packet PA1's ID data 125 indicates an ID number having a smallest value is displayed preferentially. Note that operation unit 104 may be adapted to be operated by the user to switch the code of the error of each water heating apparatus 20 indicated in table 10J and thus display the code on output unit 105.

Third Embodiment

Figure 18A:
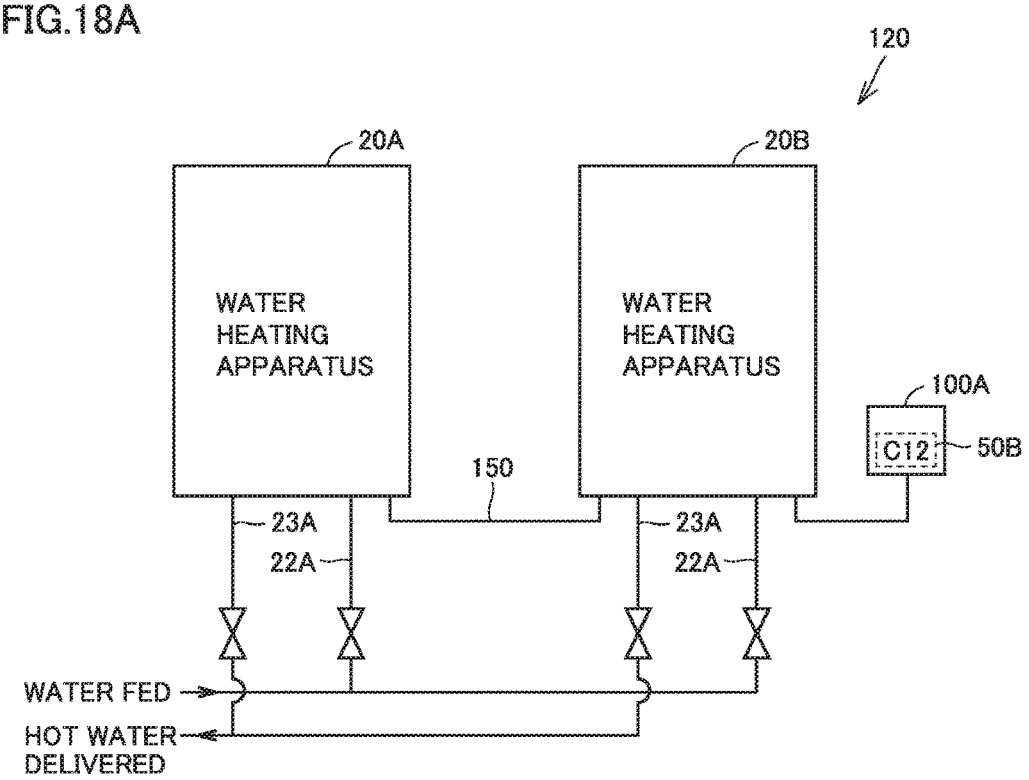
FIG. 18A and FIG. 18B are schematic configuration diagrams of a water heating system 120 according to a third embodiment.
Figure 18B:
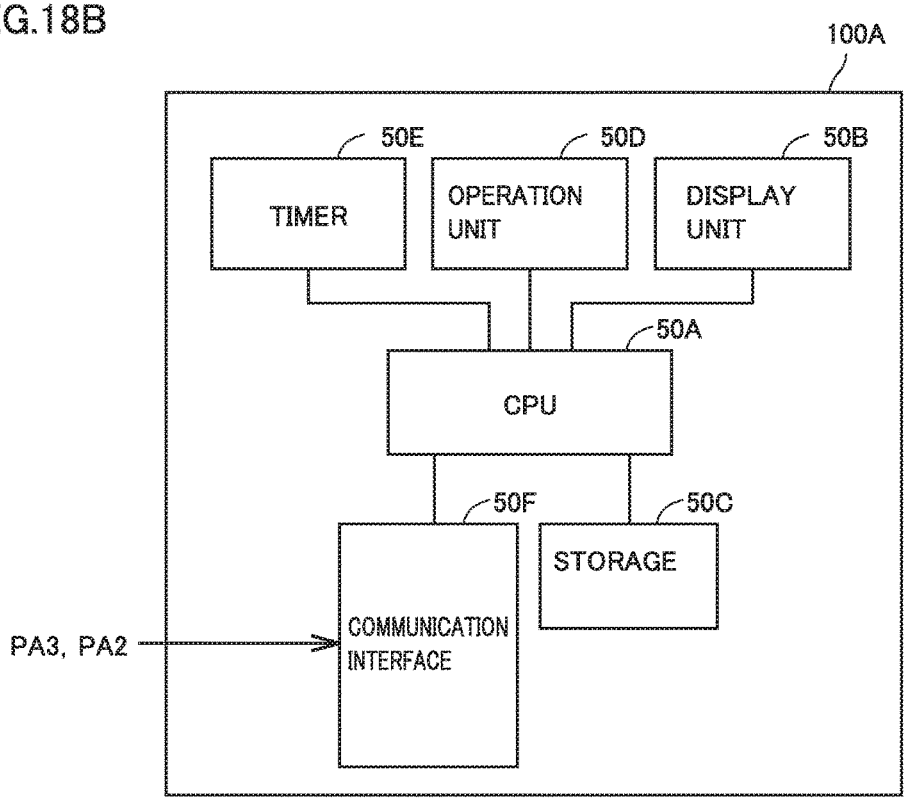

A third embodiment indicates an exemplary variation of each of the above embodiments. In the third embodiment is indicated a method of outputting an error indicating clogging with scale in a 2-coupled-type water heating system 120 having two water heating apparatuses 20 coupled together. FIG. 18A and FIG. 18B are schematic configuration diagrams of water heating system 120 according to the third embodiment.

With reference to FIG. 18A, water heating system 120 includes two coupled water heating apparatuses 20A and 20B. Water heating apparatus 20A is connected to water heating apparatus 20B by a coupling code 150 which is a communication cable. Water heating apparatus 20A is a master water heating apparatus with a display device 100A connected thereto, and water heating apparatus 20B is a slave water heating apparatus. Note that the communication channel for water heating apparatuses 20A and 20B to communicate with each other is not limited to being wired and may be wireless.

Master water heating apparatus 20A generally controls both water heating apparatuses 20A and 20B. On the other hand, slave water heating apparatus 20B implements permission for combustion only when the hot water supply operation is permitted by a control signal issued from master water heating apparatus 20A.

In storage 10*f* of water heating apparatus 20, a master identifier "M" is stored when water heating apparatus 20 of interest is designated as the master, whereas a slave identifier "S" is stored when water heating apparatus 20 of interest is designated as the slave. Water heating apparatuses 20A and 20B have the master identifier "M" or the slave identifier "S" set by an operation of a switch (not shown). Control unit 10 starts a program for operating a water heating apparatus as a master when the master identifier "M" is set therefor, and control unit 10 starts a program for operating the water heating apparatus as the slave when the slave identifier "S" is set therefor.

Display device 100A corresponds to a computer which has a function of a display device which displays information regarding an operation of water heating apparatuses 20A and 20B on display unit 50B. With reference to FIG. 18B, display device 100A includes a CPU (central processing unit) 50A, a liquid crystal or like display unit 50B, a storage 50C, an operation unit 50D for receiving a user operation, a timer 50E for counting a display period etc., and a communication interface 50F for communicating with another water heating apparatus. Communication interface 50F receives data including packets PA2 and PA3 received from master water heating apparatus 20A.

Figure 19:
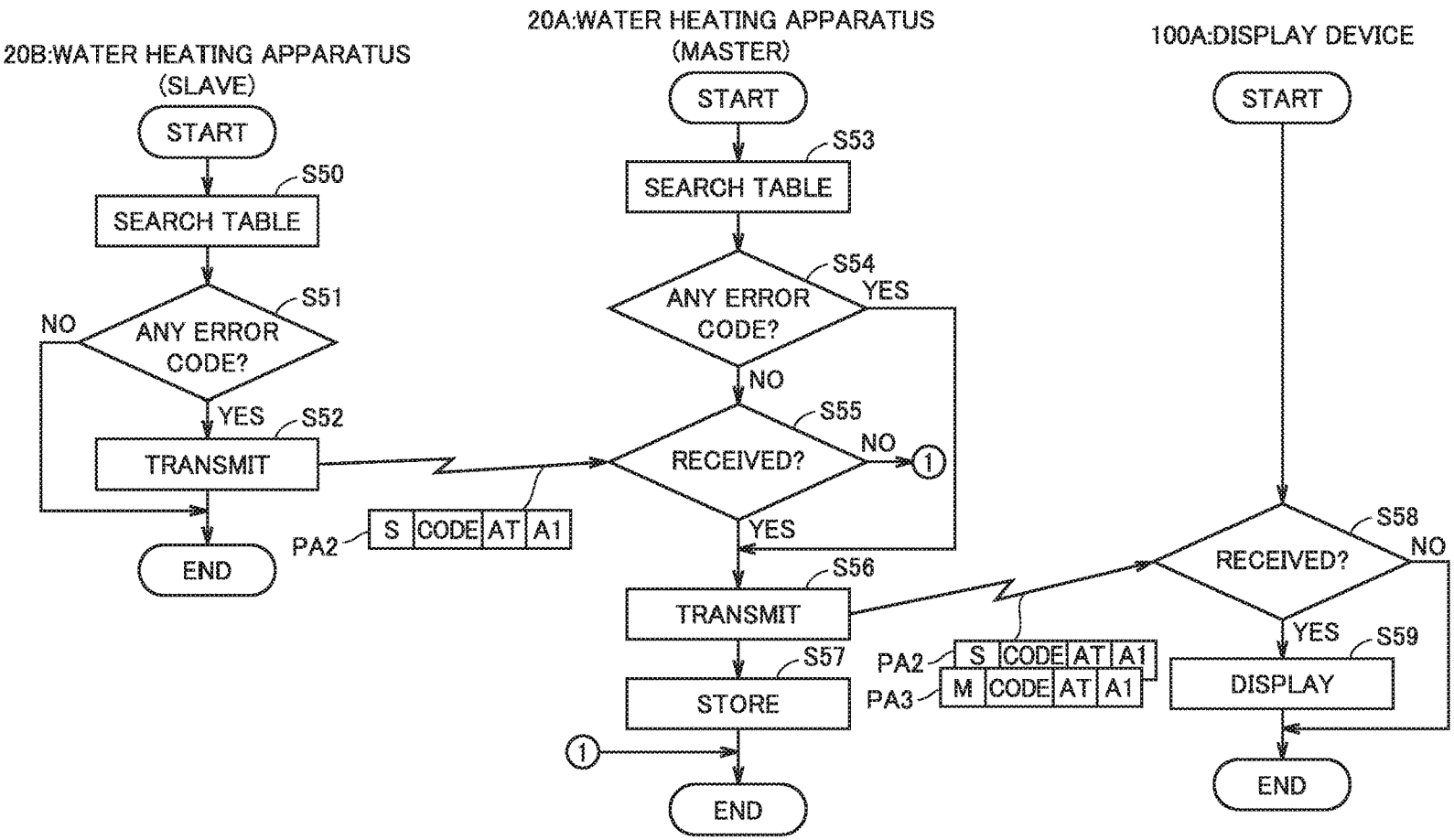
FIG. 19 is a flowchart of a process for outputting an error according to the third embodiment.

While in the first embodiment the error indicating clogging of water heating apparatus 20 with scale is output to display unit 11, in water heating system 120 the error is displayed on display unit 50B of display device 100A in place of display unit 11 or as well as display unit 11. With reference to FIG. 19 to FIG. 21A and FIG. 21B, a process for outputting an error in water heating system 120 will be described. FIG. 19 is a flowchart of a process for outputting an error according to the third embodiment. A program according to the processing flow of FIG. 19 is stored in storage 50C of display device 100A, and storage 10*f* of water heating apparatus 20. When CPU 50A executes the program of storage 50C, and furthermore, MPU 18 of control unit 10 executes the program of storage 10*f*, the process is implemented.

Figure 21A:
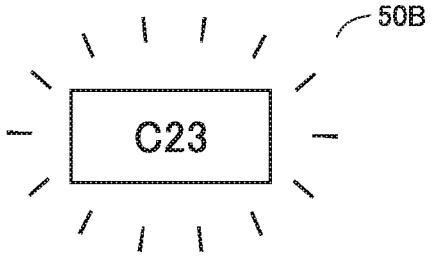
FIGS. 21A and 21B show an example of displaying an error by a display unit 50B according to the third embodiment.
Figure 21B:
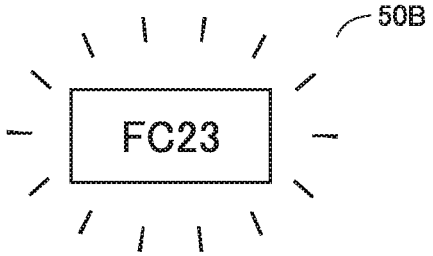

FIG. 20 shows a table 10K which manages an error according to the third embodiment. In storage 10*f* of master water heating apparatus 20A, table 10G described above and table 10K of FIG. 20 are stored. In table 10K, an identifier which identifies the master or the slave, a 2-digit error code, cumulative time AT, and a code A1 described later are associated with one another and thus registered for each water heating apparatus 20 from which an error indicating occurrence of clogging with scale is detected. FIGS. 21A and 21B show an example of displaying an error by display unit 50B according to the third embodiment.

With reference to FIG. 19, control unit 10 of slave water heating apparatus 20B searches table 10H periodically (step S50). Based on a result of the search, when control unit 10 determines that an error code of occurrence of clogging with scale is registered in table 10H (YES at step S51), control unit 10 generates packet PA2 having that code in table 10H stored therein, and transmits packet PA2 to display device 100A (step S52). When control unit 10 determines that no error code of occurrence of clogging with scale is registered in table 10H (NO at step S51), packet PA2 is not transmitted and the process ends.

Packet PA2 includes the slave identifier "S" of storage 10*f*, a code of an error of two digits, cumulative time AT, and code A1, as shown in FIG. 19. Code A1 is a 1-digit code obtained by slave water heating apparatus 20B searching table 10G of storage 10*f* of its own, based on cumulative time AT.

Furthermore, in master water heating apparatus 20A, control unit 10 searches table 10H periodically (step S53). Based on a result of the search, when control unit 10 determines that a code of an indicating occurrence of clogging with scale is registered in table 10H (YES at step S53), control unit 10 generates packet PA3 having that code in table 10H stored therein, and transmits packet PA3 to display device 100A (step S56). Packet PA3 includes the master identifier "M", a code of an error of two digits, cumulative time AT, and code A1, as shown in FIG. 19. Code A1 is a 1-digit code obtained by master water heating apparatus 20A searching table 10G of storage 10*f* of its own, based on cumulative time AT.

When control unit 10 determines that no code of an error indicating occurrence of clogging with scale is registered in table 10H (NO at step S54), packet PA3 is not generated and the control moves to step S55.

Furthermore, control unit 10 of master water heating apparatus 20A determines whether packet PA2 is received from slave water heating apparatus 20B (step S55). When packet PA2 is received (YES at step S55), packet PA2 is transmitted to display device 100A (step S56).

Thus, master water heating apparatus 20A transmits to display device 100A packet PA3 having stored therein a code of an error indicating occurrence of clogging with scale in itself and also relays packet PA2 from slave water heating apparatus 20B and transmits it to display device 100A.

The process of FIG. 19 on the side of display device 100A is performed periodically. Once the process is started, CPU 50A determines whether packet PA2 or PA3 is received from master water heating apparatus 20A (step S58). When CPU 50A determines that the packet is not received (NO at step S58), CPU 50A ends the process, whereas when CPU 50A determines that the packet is received (YES at step S58), CPU 50A generates display data based on the contents of packet PA2 or PA3 received, and controls display unit 50B based on the generated display data (step S59). Thus, display unit 50B displays an image according to an error in packet PA2 or PA3 indicating clogging with scale (see FIG. 21A and FIG. 21B).

CPU 50A generates 3-digit display data of a code of an error of two digits in packet PA2 or PA3 and 1-digit code A1 corresponding to cumulative time AT combined together. For example, when packet PA3 from master water heating apparatus 20A indicates an error having a code of "C2", and code A1 of "3", display unit 50B displays "C23" of FIG. 21A. Furthermore, for example, when packet PA2 from slave water heating apparatus 20B indicates an error having a code of "C2", and code A1 of "3", display unit 50B displays "FC23" of FIG. 21B. The character "F" at the top of this "FC23" is added to indicate that the code of the error of interest corresponds to slave water heating apparatus 20B, based on the identifier "S" of packet PA2. Note that the data added to distinguish an error of the master water heating apparatus and that of the slave water heating apparatus is not limited to "F."

Thus, display device 100A can indicate for each water heating apparatus 20 of water heating system 120 a code of an error indicating occurrence of clogging with scale (i.e., how many times clogging with scale has occurred) and cumulative time AT.

When packets PA2 and PA3 are transmitted to display device 100A, control unit 10 of master water heating apparatus 20A stores the contents of packet PA2 or PA3 to table 10K (step S59). As indicated in FIG. 20, for each of master water heating apparatus 20A and slave water heating apparatus 20B, an identifier ("M" or "S"), a code of an error, and cumulative time AT are associated with one another and stored to table 10K.

Master water heating apparatus 20A may transmit table 10K to display device 100A. CPU 50A stores table 10K that is received to storage 50C. A switching operation of operation unit 50D allows CPU 50A to switch a code of an error of each water heating apparatus 20 indicated table 10K of storage 50C to another and thus display them. Thus, as shown in FIG. 21A and FIG. 21B, if only one error code can be displayed on one screen due to a limitation of display unit 50B, an error of each water heating apparatus 20 in water heating system 120 can nonetheless be confirmed.

Fourth Embodiment

A fourth embodiment indicates an exemplary variation of each of the above embodiments. In each of the above embodiments, when occurrence of clogging with scale is determined, i.e., when a code of an error is output, the user performs an operation to connect cleaning connector 16 so that the cleaning mode may be started. When the cleaning mode of water heating apparatus 20 is performed, error ED indicating occurrence of clogging with scale is deleted from table 10H. This is referred to as clearing an error.

When an error is output by control unit 10 of water heating apparatus 20 and in that condition the error is not cleared, an operation of water heating apparatus 20 can be continued as follows:

When output control unit 10*g* outputs an error to display unit 11, permission for combustion is implemented. After the error is output, control unit 10 determines whether a first condition (MOQ is not detected continuously for a time period of five hours), a second condition (a period of 24 hours has elapsed since flag FL was set to 1), or a third condition (a period of 36 hours has elapsed since flag FL was set to 1) is established. When it is determined that none of the conditions is established, permission for combustion in water heating apparatus 20 is continuously implemented.

On the other hand, when it is determined that any one of the conditions is established, control unit 10 implements a safety operation to avoid damage to heat exchanger 3 and the like. Specifically, prohibition of combustion is implemented with an error displayed. It should be noted that the first time period of the first condition is not limited to five hours. Further, the second time period of the second condition is only required to be longer than or equal to the first time period (or five hours) and is not limited to 24 hours. Further, the third time period of the third condition is only required to be longer than or equal to the second time period (or 24 hours) and is not limited to 36 hours.

Fifth Embodiment

Figure 22:
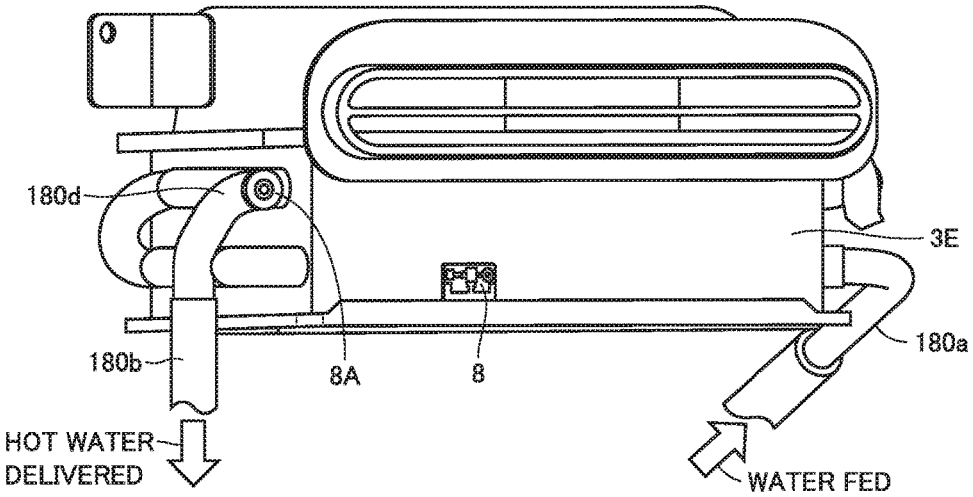
FIG. 22 shows a manner of attaching a delivered hot water thermistor 8A according to a fifth embodiment.

A fifth embodiment indicates an exemplary variation of the above embodiments. In the fifth embodiment, a threshold value indicated above for detecting clogging with scale is set variably. FIG. 22 shows a manner of attaching a delivered hot water thermistor 8A according to the fifth embodiment. With reference to FIG. 22, water heating apparatus 20 includes water heater body thermistor 8 described above, and delivered hot water thermistor 8A installed at an exit portion 180*d* of heat exchanger 3 of hot water delivery pipe 180*b*. The remainder in configuration of water heating apparatus 20 is similar to that indicated in each embodiment, and accordingly will not be described repeatedly. Delivered hot water thermistor 8A measures the temperature of a fluid (hot water etc.) delivered from heat exchanger 3. Water heating apparatus 20 variably sets a threshold value for detecting clogging with scale, based on an output of delivered hot water thermistor 8A (i.e., the temperature of hot water delivered from heat exchanger 3).

Figure 23:
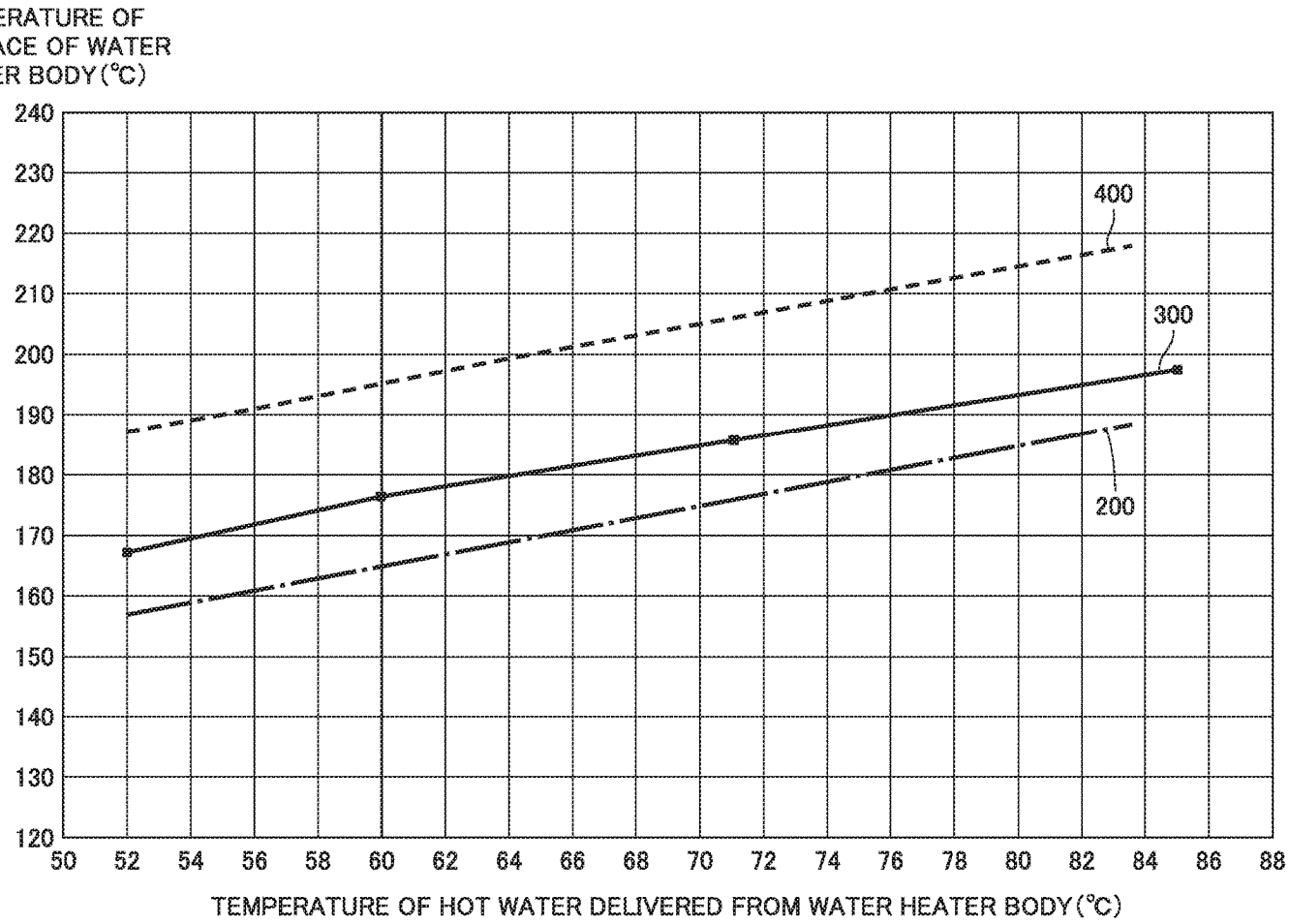
FIG. 23 shows a relationship between the temperature of hot water output from a heat exchanger 3 and that of a surface of heat exchanger 3 according to the fifth embodiment.

FIG. 23 shows a relationship between the temperature of hot water out of heat exchanger 3 and that of a surface of heat exchanger 3 according to the fifth embodiment. With reference to FIG. 23, a graph 400 represents temperature VT1 serving as a threshold value for determining that there is a large amount of adhering scale (corresponding to 190° C. of the first embodiment), and a graph 200 represents temperature VT2 serving as a threshold value for determining that scale starts to adhere to heat exchanger 3 (or that there is a small amount of adhering scale) (Note that VT2<VT1 and temperature VT2 corresponds to 160° C. of the first embodiment). In the fifth embodiment, water heating apparatus 20 sets as temperature VT1 of a threshold value a calculated value of temperature indicated by the output of delivered hot water thermistor 8A plus 135° C., as represented in graph 400. Furthermore, water heating apparatus 20 sets as temperature VT2 of a threshold value a calculated value of temperature indicated by the output of delivered hot water thermistor 8A plus 105° C., as represented in graph 200. A graph 300 indicates that the temperature measured with water heater body thermistor 8 (i.e., the temperature of a surface of water heater body 2) varies following how the temperature of hot water delivered from heat exchanger 3 varies.

Note that water heating apparatus 20 may set temperatures VT1 and VT2 of threshold values according to graph 200 and graph 400, as calculated as described above, or alternatively, may set them by searching a table where the values of graph 200 and graph 400 are registered.

Figure 24:
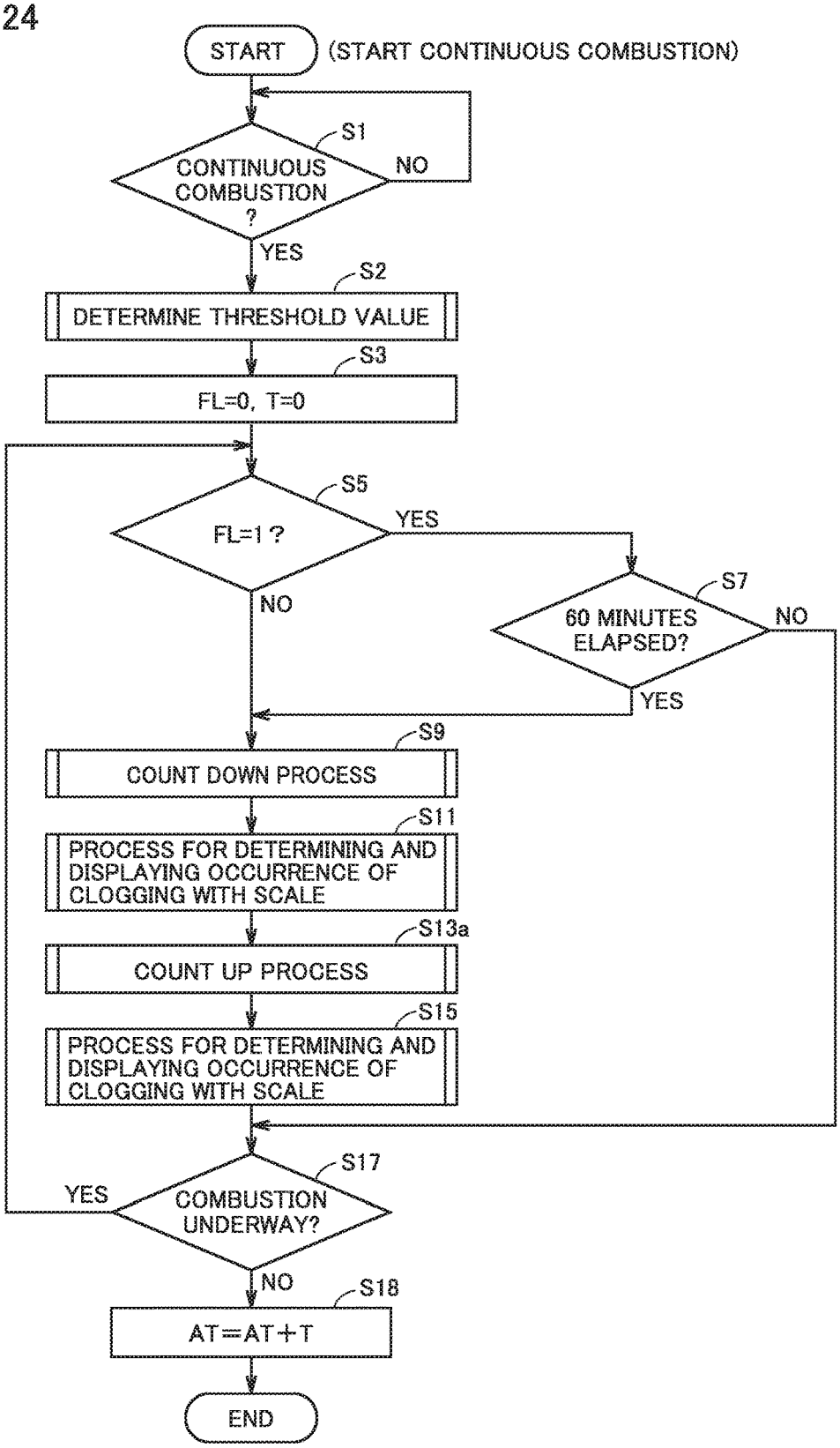
FIG. 24 is a flowchart generally indicating an overall process according to the fifth embodiment.
Figure 25:
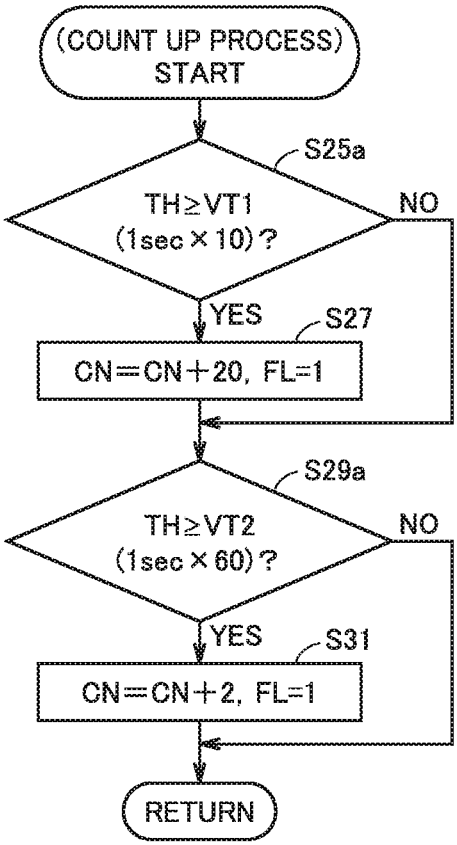
FIG. 25 is a flowchart of a count-up process according to the fifth embodiment.

FIG. 24 is a flowchart generally indicating an overall process according to the fifth embodiment. FIG. 25 is a flowchart of a count-up process according to the fifth embodiment. A program and data for processes in accordance with these flow charts are stored in advance in storage 10*f*. The process is implemented by the control unit 10 MPU 18 executing the program.

In FIG. 24, a process for setting a threshold value variably (step S2) is added to the process of FIG. 6 described above. Furthermore, in place of the count-up process of FIG. 6 (step S13), a count-up process (step S13*a*) is performed (see FIG. 25). The remainder of the process of FIG. 24 is similar to that described with reference to FIG. 6, and accordingly will not be described repeatedly.

In step S2, when control unit 10 determines that the combustion operation is continuous combustion (YES at step S1), control unit 10 determines temperatures VT1 and VT2 of the two types of threshold values described above, based on the temperature indicated by the output of delivered hot water thermistor 8A, and following graph 200 and graph 400 of FIG. 23 (Step S2). The temperatures of the threshold values that have been determined are stored to storage 10*f*. In the subsequent process, a count-up process is performed based on temperatures VT1 and VT2 stored in storage 10*f*.

With reference to FIG. 25, in the count-up process (step S13*a*), when scale detection unit 10*c* determines that a period of time for which temperature TH is equal to or greater than VT1 continues for 10 seconds (YES at step S25*a*), scale detection unit 10*c* adds 20 to cumulative value CN and sets flag FL to 1 (step S27).

When scale detection unit 10*c* determines that a period of time for which temperature TH is equal to or greater than VT1 does not continue for 10 seconds (NO at step S25*a*), scale detection unit 10*c* determines whether a period of time for which temperature TH is equal to or greater than VT2 continues for 60 seconds (step S29*a*).

When scale detection unit 10*c* determines that a period of time for which temperature TH is equal to or greater than VT2 continues for 60 seconds (YES at step S29*a*), scale detection unit 10*c* adds 2 to cumulative value CN and sets flag FL to 1 (step S31). Subsequently, the control ends the count-up process and returns to the process of FIG. 24.

While in the fifth embodiment temperatures VT1 and VT2 of the threshold values are determined based on the output of delivered hot water thermistor 8A, the method of determining them is not limited to this. As a background of the embodiments, water heating apparatus 20 determines a target temperature of heat exchanger 3 (i.e., the temperature of hot water delivered therefrom) by temperature of hot water supplied, as designated by the user, or water temperature supplied to heat exchanger 3. Accordingly, water heating apparatus 20 may determine temperatures VT1 and VT2 based on temperature of hot water supplied, as designated by the user via operation unit 17. Alternatively, water heating apparatus 20 may measure temperature of water supplied to heat exchanger 3, e.g., fluid (such as water) from pipe inlet 22A, with a temperature sensor, and determine temperatures VT1 and VT2 based on the measured temperature. Thus, temperatures VT1 and VT2 may be set variably based on a predetermined type of temperature (temperature of hot water supplied, as designated by the user, temperature of water supplied, temperature of hot water delivered, as measured with delivered hot water thermistor 8A, etc.). Furthermore, temperatures VT1 and VT2 may be set by combining this plurality of types of temperatures.

Furthermore, while in the fifth embodiment both temperatures VT1 and VT2 are set variably, at least one of them may be set variably. In that case, preferably, temperature VT1 is fixed at 190° C. and temperature VT2 is set variably.

(Exemplary Variation)

In each embodiment, the error is not limited to a code (a character) and may be indicated by a design or the like. Furthermore, when an error indicating occurrence of clogging with scale is output by an LED of water heating apparatus 20, controller 100, and display device 100A, the LED may periodically be flashed on/off as varied depending on the error's code (or how many times clogging with scale has occurred).

While the present invention has been described in embodiments, it should be understood that the embodiments disclosed herein are illustrative and non-restrictive in any respect. The scope of the present invention is defined by the terms of the claims, and is intended to include any modifications within the meaning and scope equivalent to the terms of the claims.

What is claimed is:

1. A water heating apparatus, comprising:

a burner; and a heat exchanger for heating water with use of heat from the burner, the heat exchanger including a plurality of fins and a tube:

a thermistor for measuring a surface temperature of the heat exchanger;

a storage for storing information about the water heating apparatus; and a processor, the information including a numerical value representing how many times the surface temperature measured by the thermistor exceeds at least one of a plurality of threshold values, the processor being configured such that while the burner provides combustion when the surface temperature measured by the thermistor exceeds at least one of the plurality of threshold values for a continuous period of time the processor adds a predetermined value to the numerical value in the storage, when the numerical value in the storage attains a value equal to or greater than a defined value the processor detects occurrence of clogging with scale in the tube and the processor causes an output unit to output a result of a detection by the processor, wherein the plurality of threshold values include a first threshold value and a second threshold value larger than the first threshold value;

the predetermined value includes a first value to be added when the surface temperature measured is equal to or greater than the first threshold value, and a second value to be added when the surface temperature measured is equal to or greater than the second threshold value; and the second value is larger than the first value.

2. The water heating apparatus according to claim 1, wherein the processor is configured to change at least one of the plurality of threshold values.

3. The water heating apparatus according to claim 1, wherein the processor is configured to change at least one of the plurality of threshold values, based on a predetermined temperature.

4. The water heating apparatus according to claim 3, wherein the predetermined temperature includes a temperature designated by a user.

5. The water heating apparatus according to claim 3, wherein the predetermined temperature includes a temperature of hot water from the heat exchanger while the burner provides combustion.

6. The water heating apparatus according to claim 3, wherein the predetermined temperature includes a temperature of water supplied to the water heating apparatus.

7. The water heating apparatus according to claim 1, wherein the processor is configured such that while the burner provides combustion when the surface temperature measured is smaller than any of the plurality of threshold values for a continuous period of time the processor subtracts a third value from the numerical value in the storage.

8. The water heating apparatus according to claim 7, wherein the third value is smaller than the predetermined value added to the numerical value in the storage.

9. The water heating apparatus according to claim 1, wherein:

the water heating apparatus has a cleaning mode for removing the scale; and the processor is configured to count how many times occurrence of clogging with scale is detected and cause the output unit to output the result of the detection including an error code indicating how many times occurrence of clogging with scale is detected.

10. The water heating apparatus according to claim 9, wherein:

the information in the storage includes a cumulative time indicating the burner's cumulative combustion time; and the error code includes a code indicating the cumulative time.

11. A water heating system comprising:

a plurality of water heating apparatuses each according to claim 9; and a controller communicating with the plurality of water heating apparatuses to control the plurality of water heating apparatuses, the plurality of water heating apparatuses each further including a communication unit transmitting the error code to the controller, the controller including a controller output unit outputting the error code received from each water heating apparatus.

12. A water heating system comprising:

two water heating apparatuses each according to claim 9 communicating with each other; and a display device being included in each of the output units, one of the two water heating apparatuses including a communication unit transmitting the error code of the one water heating apparatus to the other water heating apparatus, the processor of the other water heating apparatus being configured to display on the display device the error code received from the one water heating apparatus or the error code of the other water heating apparatus.

* * * * *